US005082764A

United States Patent [19]

Takahashi

[11] Patent Number: 5,082,764

[45] Date of Patent: Jan. 21, 1992

[54] SILVER HALIDE COLOR PHOTOGRAPHIC MATERIAL AND METHOD FOR FORMING COLOR IMAGE

[75] Inventor: Osamu Takahashi, Minami-ashigara, Japan

[73] Assignee: Fuji Photo Film Co., Ltd., Kanagawa, Japan

[21] Appl. No.: 603,613

[22] Filed: Oct. 26, 1990

[30] Foreign Application Priority Data

Oct. 30, 1989 [JP] Japan ..... 1-282318

[51] Int. Cl.[5] ..... G03C 7/36

[52] U.S. Cl. ..... 430/377; 430/505; 430/545; 430/546; 430/551; 430/552; 430/553

[58] Field of Search ..... 430/546, 551, 552, 553, 430/545, 505, 377

[56] References Cited

U.S. PATENT DOCUMENTS

| | | | |
|---|---|---|---|
| 4,686,177 | 8/1987 | Aoki et al. | 430/553 |
| 4,857,449 | 8/1989 | Ogawa et al. | 430/546 |
| 4,945,031 | 7/1990 | Sakai et al. | 430/551 |
| 4,971,898 | 11/1990 | Aoki et al. | 430/553 |
| 5,006,453 | 4/1991 | Takahashi et al. | 430/546 |

FOREIGN PATENT DOCUMENTS 0280238 8/1988 European Pat. Off. .

OTHER PUBLICATIONS

Patent Abstracts of Japan, vol. 13, No. 159 (P-858)(3507) 04/18/89, & JP-A-316857 (Fuji) 12/26/88.

*Primary Examiner*—Richard L. Schilling

*Attorney, Agent, or Firm*—Burns, Doane, Swecker & Mathis

[57] ABSTRACT

There is disclosed a silver halide color photographic material having at least one silver halide emulsion layer on a base, which comprises in the silver halide emulsion layer a silver halide grains of high silver-chloride and an emulsified dispersion containing lipophilic fine particles that have a limited average particle diameter and include a cyan coupler represented by formula (I), a high-boiling organic solvent having a limited viscosity, and a diffusion-resistant compound represented by formula (II) or (III), and a method for forming an image by developing the said silver halide color photographic material. The disclosure as described provides a color photographic material and a method for forming an image being excellent in image quality and preservation property of cyano color image.

19 Claims, No Drawings

SILVER HALIDE COLOR PHOTOGRAPHIC MATERIAL AND METHOD FOR FORMING COLOR IMAGE

FIELD OF THE INVENTION

The present invention relates to silver halide color photographic material and a method for forming an image, and more particularly to a method for forming an image wherein the image quality after the color development processing step is improved and the change of the image owing to the change in the cyan dye density during storage of the print is improved.

BACKGROUND OF THE INVENTION

In order to form a color photographic image, three color photographic couplers, that is, a yellow coupler, a magenta coupler, and a cyan coupler, are contained in photosensitive layers, and after exposure to light, they are processed with a color developer containing a color-developing agent. In this process, the couplers couple with the oxidized product of the aromatic primary amine to provide color-formed dyes.

Generally, the standard processing step of silver halide color photographic materials consists of a color-developing step of forming a color image, a desilvering step of removing developed silver and undeveloped silver, and a washing step and/or an image stabilizing step.

Although in the past it has been attempted to shorten the processing time, recently the need for shortening of the processing time has increased further because there are, for example, a demand for shortening of the delivery time of the finished product, a demand for reducing the work load in a laboratory, a demand for compactness of the processing system for a small-scale laboratory, that is, a so-called mini-lab, and a demand for simplification of the operation.

Shortening of the time of the color-developing step can be attained by using couplers whose coupling speeds are increased as much as possible, by using silver halide emulsions whose developing speeds are high, by using color developers whose developing speeds are high, by elevating the temperature of color developers, by using a suitable combination of these.

As another technique to increase the coupling speed, for example, as described in JP-A ("JP-A" means unexamined published Japanese patent application) No.172349/1987, there is a method wherein the average particle diameter of lipophilic fine particles, consisting of a specific coupler solvent and a coupler, is made small.

The shortening of the desilvering step can be achieved by lowering the pH of the bleaching solution and the bleach-fixing solution. The fact that the bleach-fixing can be quickened by lowering the pH of the bleach-fixing solution is described by T.H. Jamos in *The Theory of the Photographic Process*, (Macmillan Publishing Co., Inc.), Section 15, E, Bleach-Fix System.

However, although the bleaching speed is increased by lowering the pH of the bleach-fixing solution, the dye formed from the cyan coupler forms a colorless so-called leuco dye (leucolization) in the bleach-fixing solution, which is apt to cause the density to lower (this phenomena will be referred to as blix fading hereinafter). This leuco dye will be oxidized with oxygen in the air or the like after the processing and will gradually turn back to the original cyan dye over a few months (color restoration). This means that the color balance of a photograph that is excellent in color balance after processing will gradually become disturbed and the image quality lowers, which is a great problem.

As means of improving that, there is a method wherein after the color development, the color photographic material is washed with water, the developing agent is removed, and the photographic material is subjected to bleach-fixing processing, but this method has defects that the number of processing steps is increased and the total processing time becomes long.

As other means, a technique is suggested, for example, in U.S. Pat. No. 3,773,510, wherein a water-soluble ionic compound containing a polyvalent element is added to a bleach-fixing solution, but this technique has the defect that the pollution load increases, and in addition the intended purpose is still not adequately attained.

Further, JP-A No. 316857/1988 describes that an improvement can be made by using a certain hydroquinone or quinone derivative. According to this technique, indeed, a certain effect can be obtained, and it is effective in the case of couplers wherein the cyan dye itself is hardly changeable to a leuco dye, but with couplers wherein the dye is readily changeable to a leuco dye or when the bleaching solution has been exhausted and the oxidizing strength has dropped, the effect is not satisfactory, and therefore a technique is still sought for further improvement. We, the inventors, studied and found that when a coupler is emulsified and dispersed by using a coupler solvent whose viscosity is relatively high and the average particle diameter of the particles of the emulsified dispersion is adjusted to be within a relatively large range, blix fading can be improved. However, in this case we encountered a problem that the color-forming properties lowered, and therefore a technique is sought wherein the color-forming properties are good and blix fading is not brought about.

SUMMARY OF THE INVENTION

The invention has been made taking the above problems into consideration, and the first object of the present invention is to provide a color photographic material and a method for forming an image by which color development processing can be completed in a short period of time and a color photograph excellent in image quality can be produced.

The second object of the present invention is to provide a method for forming an image which gives a color photograph whose color-forming properties are high and wherein blix fading of the formed dye image is improved and the color balance of the image after processing does not become disturbed, so that the image quality is improved.

other and further objects, features, and advantages of the invention will appear more fully from the following description.

DETAILED DESCRIPTION OF THE INVENTION

The inventors have studied keenly in various ways and have found that the above objects of the present invention can be solved unexpectedly effectively by improving the technique described in the above JP-A No. 316857/1988 in such a way that the average particle diameter of the particles of the emulsified dispersion is controlled to be within a relatively large range, and for the coupler in the emulsified dispersion, a cyan coupler represented by formula (I), described in detail later, is used, leading to the present invention.

That is, the present invention provides a silver halide color photographic material and a method for forming a color image using that same material, which are described below:

(1) A silver halide color photographic material having photographic constitutional layers that include at least one silver halide emulsion layer on a base, comprising said silver halide photographic layer contains silver halide grains having a silver chloride content of 90 mol% or over and an emulsified dispersion containing lipophilic fine particles with an average particle diameter in the range of 0.18 μm to 0.35 μm that include at least one cyan dye-forming coupler represented by formula (I):

Formula (I)

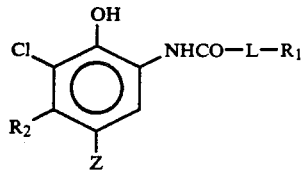

wherein $R_1$ represents an alkyl group having at least 7 carbon atoms, $R_2$ represents an alkyl group having 1 to 15 carbon atoms, L represents a mere bonding line or a bivalent linking group, and Z represents a hydrogen atom or a group or an atom capable of being released at the time of coupling with a developing agent, a high-boiling organic solvent having a viscosity of 200 cp or over at 25° C., and at least one compound selected from the group consisting of diffusion-resistant compounds represented by formulae (II) and (III):

Formula (II)

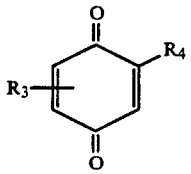

Formula (III)

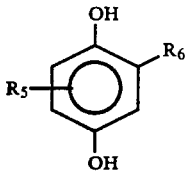

wherein $R_3$, $R_4$, $R_5$, and $R_6$ each represent a hydrogen atom, a halogen atom, or a chain, cyclic, or branched alkyl, alkyloxy, or alkylthio group, provided that $R_3$ and $R_4$ and/or $R_5$ and $R_6$ do not simultaneously represent a hydrogen atom and/or a halogen atom respectively, and of alkyl groups represented by $R_3$ to $R_6$, alkyl groups whose root carbon is a tertiary carbon atom are excluded.

(2) A silver halide color photographic material as defined under (1), characterized in that a blue-sensitive silver halide emulsion layer contains lipophilic fine particles (A) containing a yellow dye-forming coupler, a green-sensitive silver halide emulsion layer contains lipophilic fine particles (B) containing a magenta dye-forming coupler, and the average particle 0.25 μm or less.

(3) A silver halide color photographic material as defined under (1) or (2), characterized in that said silver halide emulsion layer containing at least one coupler of formula (I) contains further a water-insoluble organic polymer compound.

(4) A method for forming an image, characterized in that after the silver halide photographic material as defined under (1), (2), or (3) is exposed to light imagewise, the silver halide photographic material is colorly developed with a color developer substantially free from benzyl alcohol and then is processed with a bleach-fix solution having a pH of 6.3 or below.

Now, the compounds represented by formula (I) will be described in detail.

In formula (I), $R_1$ represents an alkyl group having at least 7 carbon atoms (e.g., octyl, tert-octyl, tridecyl, pentadecyl, and eicosyl), and preferably an alkyl group having 10 to 22 carbon atoms of straight chain.

In formula (I), L represents a simple bond line or a bivalent linking group.

Herein the bivalent linking group means alkylene, phenylene, an ether bond, a carbonamido bond, a sulfonamido bond, an ester bond, a urethane bond, and the like, and a bivalent group formed by combining these groups, and examples of the combination are

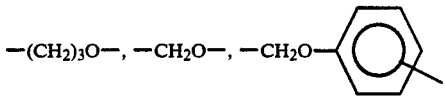

(wherein any of the o-, m-, and p-position is acceptable, and hereinafter the same is applied)

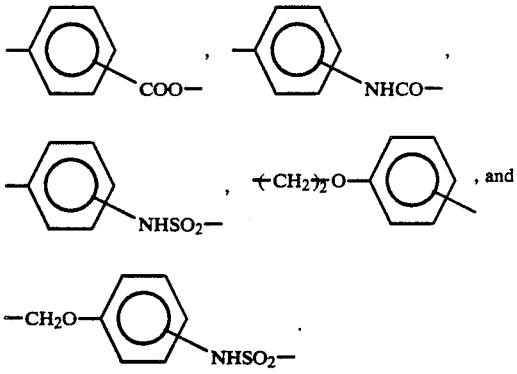

Preferably $R_2$ in formula (I) represents an alkyl group having 2 to 15 carbon atoms (e.g., ethyl, butyl, tert-butyl, cyclohexyl, and pentadecyl), more preferably, an alkyl group having 2 to 4 carbon atoms, and most preferably an ethyl group.

Z in formula (I) represents a hydrogen atom or a coupling releasing group such as a halogen atom (e.g. fluorine, chlorine, and bromine), an alkoxy group (e.g., ethoxy, dodecyloxy, methoxyethylcarbamoylmethoxy, carboxypropyloxy, methylsulfonyl, and ethoxy), an aryloxy group (e.g., 4-chlorophenoxy, 4-methoxyphenoxy, and 4-carboxyphenoxy), an acyloxy group (e.g., acetoxy, tetradecanoyloxy, and benzoyloxy), a sulfonyloxy group (e.g., methanesulfonyloxy and toluenesulfonyloxy), an amido group (e.g., dichloroacetylamino, heptafluorobutyrylamino, methanesulfonylamino, and toluenesulfonylamino), an alkoxycarbonyloxy group (e.g., ethoxycarbonyloxy and benzyloxycarbonyloxy), an aryloxycarbonyloxy group (e.g., phenoxycarbonyloxy), an aliphatic or aromatic thio group (e.g., ethylthio, phenylthio, and tetrazolylthio), an imido group (e.g., succinimido and hydantoinyl), and an aromatic group (e.g., phenylazo), which may include a photographically useful group.

Preferably, Z in formula (I) represents a hydrogen atom or a halogen atom and, most preferably, chlorine or fluorine.

In this specification and claims, by "aliphatic group" is meant a straight-chain, branched or cyclic aliphatic hydrocarbon group with an alkyl group, an alkenyl group, and an alkynyl group inclusive which may be saturated or unsaturated. Typical examples thereof include methyl, ethyl, butyl, dodecyl, octadecyl, eicosenyl, iso-propyl, tert-butyl, tert-octyl, tert-dodecyl, cyclohexyl, cyclopentyl, ally, vinyl, 2-hexadecenyl, and propargyl.

In formula (I), the alkyl group, the aliphatic group, the aromatic group, and the substitutable linking group (e.g., alkylene and a phenyleneamido bond) may be further substituted by a group selected from among an alkyl group, an aryl group, a heterocyclic group, an alkoxy group (e.g., methoxy and 2-methoxyethoxy group), an aryloxy group (e.g., 2,4-di-tert-amylphenoxy, 2-chlorophenoxy, and 4-cyanophenoxy), an alkenyloxy group (e.g., 2-propenyloxy), an acyl group (e.g., acetyl and benzoyl), an ester group (e.g., butoxycarbonyl, phenoxycarbonyl, acetoxy, benzoyloxy, butoxysulfonyl, and toluenesulfonyloxy), an amido group (e.g., acetylamino group, ethylcarbamoyl, dimethylcarbamoyl, methanesulfonamido, and butylsulfamoyl), a sulfamido group (e.g., dipropylsulfamoylamino), an imido group (e.g., succinimido and hydantoinyl), a ureido group (e.g., a phenylureido and dimethylureido), an aliphatic or aromatic sulfonyl group (e.g., methanesulfonyl and phenylsulfonyl), an aliphatic or aromatic thio group (e.g., ethylthio and phenylthio), a hydroxy group, a cyano group, a carboxy group, a nitro group, a halogen atom, etc.

Specific examples of the compound represented by formula (I) that can be used in the present invention are shown below, but the present invention is not limited to them.

Formula (I)

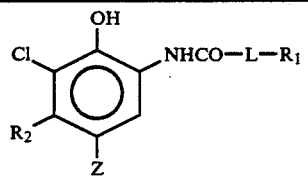

| Compound No. | $R_2$ | L | $R_1$ | Z |
|---|---|---|---|---|
| I-1 | $C_2H_5$— | — | —$C_{11}H_{21}$(n) | Cl |
| I-2 | " | " | —$C_{13}H_{27}$(n) | " |
| I-3 | " | " | —$C_{15}H_{31}$(n) | " |
| I-4 | " | " | —$C_{17}H_{35}$(n) | " |
| I-5 | " | " | —$C_{21}H_{43}$(n) | " |
| I-6 | " | $OC_2H_5$ \| —CH | —$C_{12}H_{25}$(n) | " |
| I-7 | " | 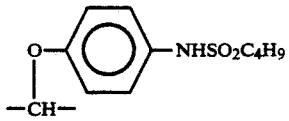 | " | " |
| I-8 | " | 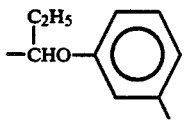 | —$C_{15}H_{31}$(n) | " |
| I-9 | " | 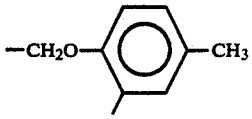 | —$C_{10}H_{21}$(n) | " |
| I-10 | (i)$C_3H_7$— | — | —$C_{17}H_{33}$(n) | " |
| I-11 | (n)$C_4H_9$— | " | —$C_{15}H_{31}$(n) | F |
| I-12 | (t)$C_4H_9$— | " | —$C_{13}H_{27}$(n) | Cl |
| I-13 | (n)$C_{15}H_{31}$— | " | —$C_9H_{19}$(n) | " |
| I-14 | $C_2H_5$— | 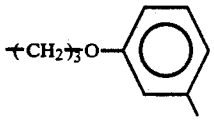 | —$C_{15}H_{31}$ | " |

-continued

Formula (I)

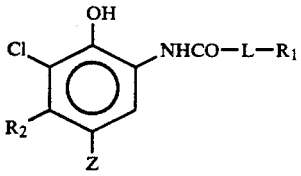

| Compound No. | $R_2$ | L | $R_1$ | Z |
|---|---|---|---|---|
| I-15 | | 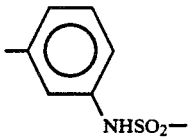 | $-C_{16}H_{33}(n)$ | " |
| I-16 | | 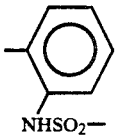 | $-C_{12}H_{25}(n)$ | " |
| I-17 | " | " | $-C_{17}H_{35}(iso)$ | " |
| I-18 | $(n)C_8H_{17}-$ | " | $-\overset{C_2H_5}{\overset{\vert}{C}}HC_4H_9$ | " |
| I-19 | $C_2H_5-$ | 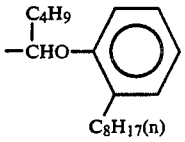 | $-C_8H_{17}(n)$ | " |
| I-20 | " | 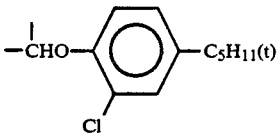 | " | " |

Now, the compounds represented by formulae (II) and (III) will be described in detail.

Preferably $R_4$ or $R_6$ represents an alkyl group or an alkylthio group having 6 to 22 carbon atoms, and more preferably an alkyl group having 6 to 22 carbon atoms (e.g., octyl, pentadecyl, and octadecyl), which may be straight-chain, cyclic, or branched, provided that those whose root carbon is a tertiary carbon are excluded. $R_3$ or $R_5$ is preferably a hydrogen atom or a halogen atom.

To allow these compounds to be resistant to diffusion in the photosensitive layer, it is preferable that the total number of carbon atoms of $R_3$ plus $R_4$ or $R_5$ plus $R_6$ is 8 or over, and more preferably 12 or over.

Examples of the compounds of formulae (II) and (III) are given below, but the present invention is not limited to them.

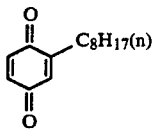

(II-1)

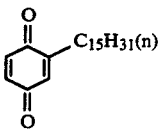

(II-2)

-continued

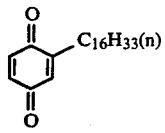

(II-3)

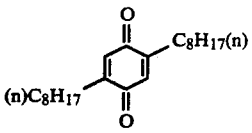

(II-4)

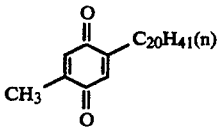

(II-5)

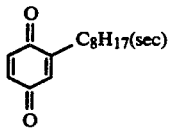

(II-6)

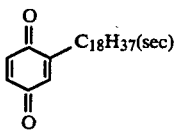

(II-7)

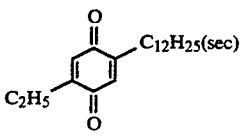

(II-8)

-continued

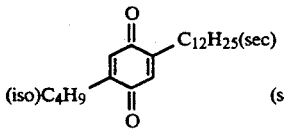

(II-9)

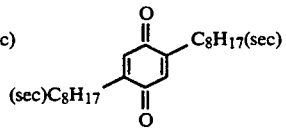

(II-10)

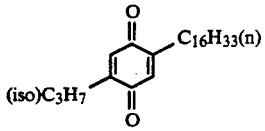

(II-11)

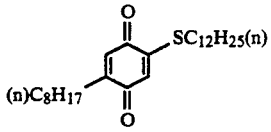

(II-12)

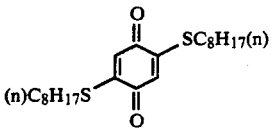

(II-13)

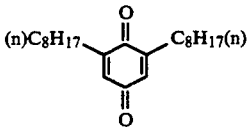

(II-14)

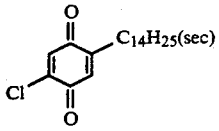

(II-15)

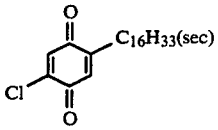

(II-16)

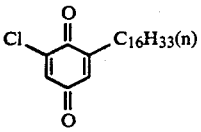

(II-17)

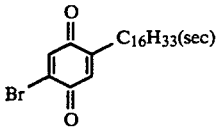

(II-18)

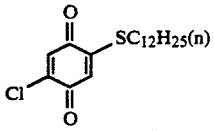

(II-19)

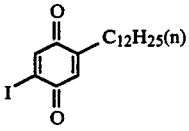

(II-20)

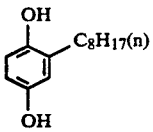

(III-1)

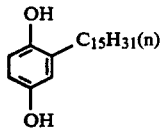

(III-2)

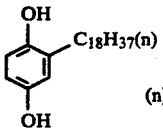

(III-3)

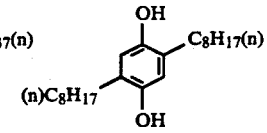

(III-4)

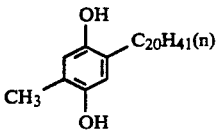

(III-5)

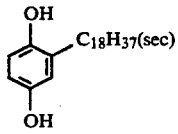

(III-6)

-continued

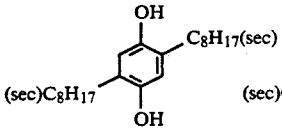

(III-7)

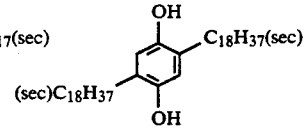

(III-8)

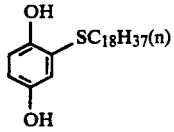

(III-9)

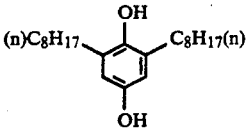

(III-10)

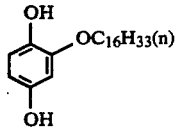

(III-11)

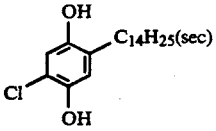

(III-12)

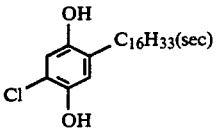

(III-13)

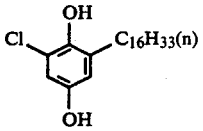

(III-14)

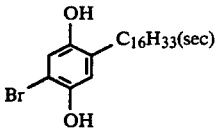

(III-15)

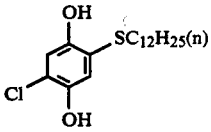

(III-16)

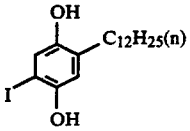

(III-17)

Quinones of formula (II) and/or hydroquinones of formula (III) of the present invention are used in an amount of 0.1 to 100 mol%, preferably 0.5 to 30 mol%, and more preferably 2 to 25 mol% per mol of the cyan coupler. As described above, the present invention can be applied to any materials that use the above-mentioned system and to any processing system. If the compound of formula (III) and the compound of formula (II) are used together, the ratio of them can be changed arbitrarily, although preferably that the molar ratio of the compound of formula (III) to the compound of formula (II) is from 0.01:1 to 10:1.

Preferably the cyan coupler of the present invention is used in an amount of 0.1 to 1 mol%, and more preferably 0.2 to 0.5 mol%, per mol of the silver halide of the photosensitive silver halide emulsion layer into which the cyan coupler is introduced.

Preferably the average particle diameter of the emulsified dispersion of lipophilic fine particles made up of a cyan coupler of the present invention, a quinone and/or a hydroquinone, and a high-boiling organic solvent having a viscosity of 200 cp or over, is 0.18 to 0.29 μm.

The particle diameter of such lipophilic particles can be determined by an apparatus, for example, Nanosizer made by Coulter Co. in England.

Next, the high-boiling organic solvent having a viscosity of 200 cps (25° C.) for use in the present invention will be described.

The high-boiling organic solvent is preferably selected from the group of compounds represented by the following formulae ($II_s$), ($III_s$), ($IV_s$), ($V_s$), ($VI_s$), and ($VII_s$).

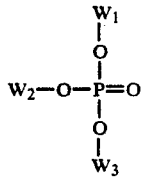

Formula ($II_s$)

$W_1—COOW_2$ Formula ($III_s$)

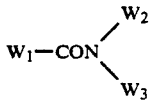

Formula ($IV_s$)

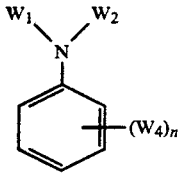

Formula ($V_s$)

$W_1—O—W_2$ Formula ($VI_s$)

$W_5—X$ Formula ($VII_s$)

wherein $W_1$, $W_2$, and $W_3$ each represent a substituted or unsubstituted alkyl group, cycloalkyl group, alkenyl group, aryl group, or heterocyclic group, $W_4$ represents $W_1$, O-$W_1$ or S-$W_1$, n is an integer of 1 to 5, when n is 2 or over, $W_4$ groups may be the same or different, and in formula ($VI_s$), $W_1$ and $W_2$ may together form a condensed ring. $W_5$ represents a substituted or unsubstituted alkyl group, cycloalkyl group, or aryl group, the total number of carbon atoms constituting of $W_5$ being 12 or more, and X represents a halogen atom.

When the group represented by the above $W_1$, $W_2$, and $W_5$ have substituents, the substituent may be a group having one or more bonding groups selected from

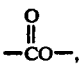

—CON, —$R^8$N ($R^8$ represents a 2- to 6-valent group being removed hydrogen atom from a phenyl group).

Alkyl group represented by $W_1$, $W_2$, $W_3$, $W_4$, and $W_5$ may be either straight chain or branched chain group, for example, methyl group, ethyl group, propyl group, butyl group, benzyl group, hexyl group, heptyl group, octyl group, nonyl group, decyl group, undecyl group, dodecyl group, tridecyl group, tetradecyl group, pentadecyl group, hexadecyl group, heptadecyl group, octadecyl group, nonadecyl group, or eicocyl group.

The acceptable substituents for these alkyl group include, for example, a halogen atom, a cycloalkyl group, an aryl group, and an ester group, and as such substituted alkyl group can be mentioned, for example, a substitution product of halogen (e.g., —$C_2HF_4$, —$C_5H_3F_8$, —$C_9H_3F_{16}$, —$C_2H_4Cl$, —$C_3H_6Cl$, —$C_3H_5Cl_2$, —$C_3H_5ClBr$, and —$C_3H_5Br_2$), a substitution product of cycloalkyl group (e.g.,

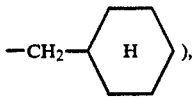

a substitution product of aryl group

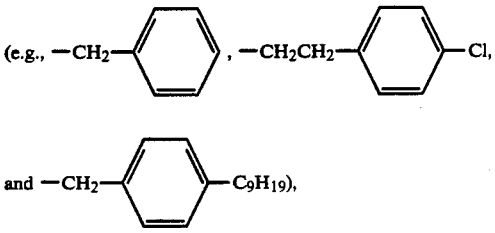

a substituent to give an ester of dibasec acid (e.g.,

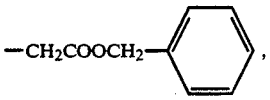

—$CH_2CH_2COOC_{12}H_{25}$, —$(CH_2)_4COOC_{10}H_{21}$, —$(CH_2)_4COOC_2(CF_2CF_2)_2H$, —$(CH_2)_7COOC_4H_9$, and —$(CH_2)_8COOC_{12}H_{25}$), a substituent to give an ester of lactic acid (e.g.,

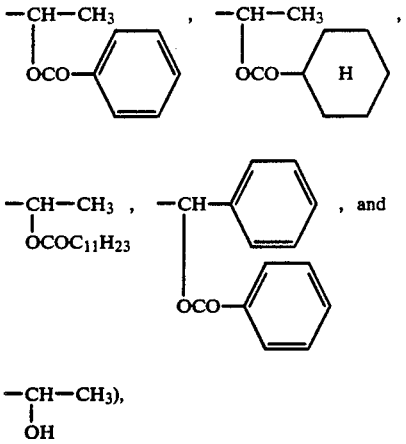

a substituent to give an ester of citric acid or the like (e.g.,

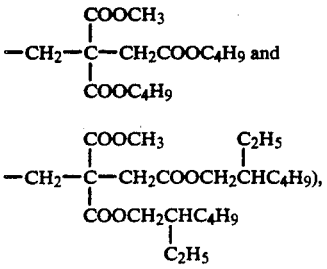

a substituent to give an ester of malic acid (e.g., $-CH_2CH(OH)COOC_6H_{13}$ and $-CH_2CH(OH)-COOC_{12}H_{25}$), and a substituent to give an ester of tartalic acid (e.g., $-CH_2(OH)CH(OH)COOC_8H_{17}$, $-CH_2(OH)CH(OH)COOC_{18}H_{37}$,

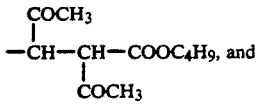

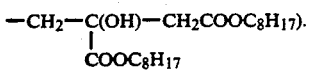

Further, in formula ($VI_5$), $W_1$ and $W_2$ may be a group that contain oxirane, oxolane, and oxane ring being formed a condensed ring.

The cycloalkyl groups represented by $W_1$, $W_2$, $W_3$, $W_4$, or $W_5$ include, for example,

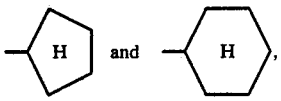

and the substituted cycloalkyl groups include, for example,

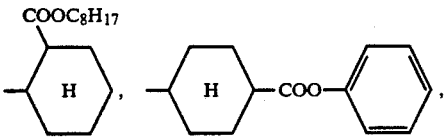

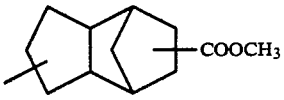

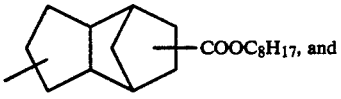

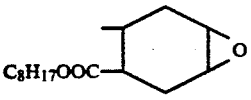

The aryl groups represented by $W_1$, $W_2$, $W_3$, $W_4$, or $W_5$ include, for example,

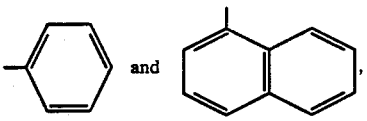

and the substituted aryl groups include, for example,

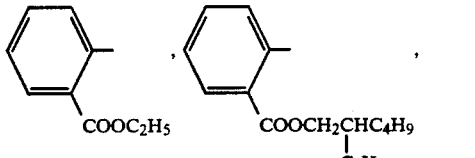

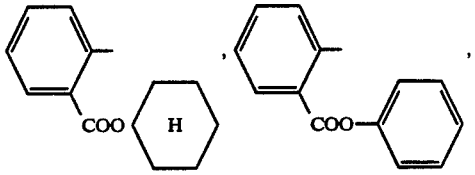

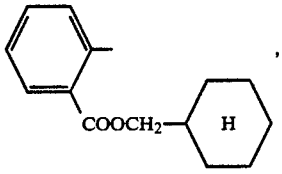

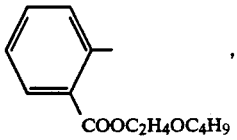

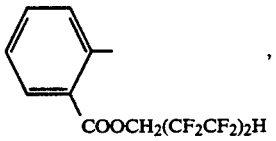

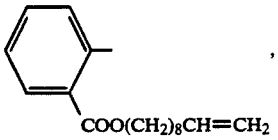

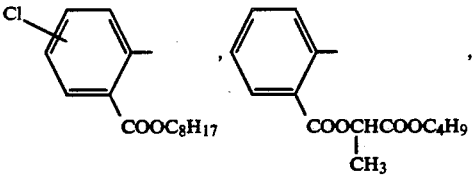

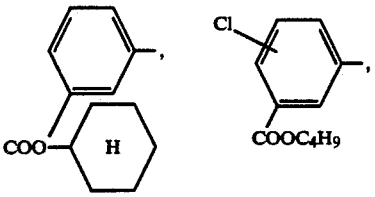

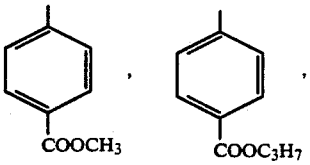

-continued

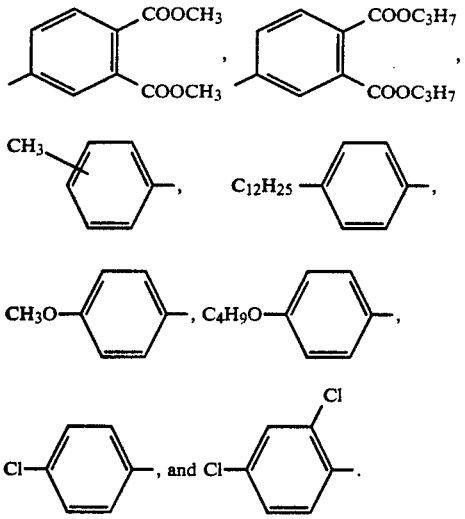

The alkenyl groups $W_5$ include, for example, $—C_4H_7$, $—C_5H_9$, $—C_6H_{11}$, $—C_7H_{13}$, $—C_8H_{15}$, $—C_{10}H_{19}$, $—C_{12}H_{23}$, and $—C_{18}H_{35}$, and the substituted alkenyl groups include, for example, substituted groups of a halogen atom (e.g., F, Cl, and Br),$—OC_8H_{17}$, $—OC_{12}H_{25}$,

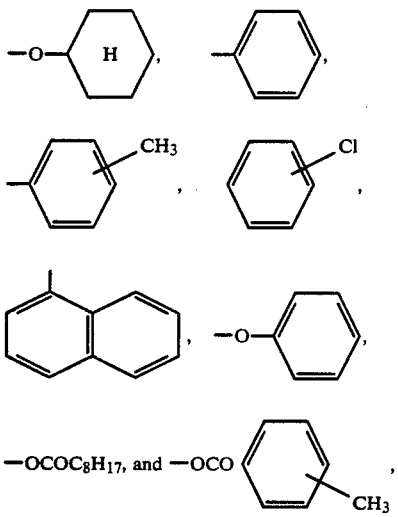

that is, $—CH=CH—COOCH_2CHC_4H_9$, $C_2H_5$ $—CH=CH—COOC_{12}H_{25}$, and

-continued

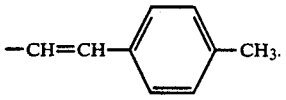

Preferably the boiling point of the high-boiling organic solvent used in the present invention is 140° C. or over, and more preferably 160° C or over. Preferably $W_1$ to $W_5$ of these compounds each represent an alkyl group, preferably having 8 or more carbon atoms in all.

Although, generally the term "organic solvents" means solvents that are liquid, in the present invention the term "organic solvents having a viscosity of 200 cp or over measured at 25° C." includes solid solvents, preferably Preferably the boiling point of the high-boiling organic solvent used in the present invention is 140° C. or over, and more preferably 160° C. or over. Preferably $W_1$ to $W_5$ of these compounds each represent an alkyl group, preferably having 8 or more carbon atoms in all.

Although, generally the term "organic solvents" means solvents that are liquid, in the present invention the term "organic solvents having a viscosity of 200 cp or over measured at 25° C." includes solid solvents, preferably having a viscosity of 500 cp or over, and more preferably 700 cp or over, and further preferably solid solvents selected from compounds having a melting point of 25° C. or over represented by formulae ($II_s$) to ($VIII_s$). Above all those represented by formulae ($II_s$) and ($III_s$) are preferable, with esters of dialkyls (secondary and tertiary alkyls) or dicycloalkyls of phosphoric acid and phthalic acid particularly preferred. The most preferable ones are dicyclo esters of phthalic acid. The viscosity can be measured by a cone plate-type rotational viscometer (VISCONISEMD manufactured by Tokyo Keiki).

Although the amount of the above high-boiling organic solvent to be used can be varied suitably depending on the type and the amount of the cyan coupler to be used, preferably the weight ratio of the high-boiling organic solvent to the cyan coupler is in the rang of from 0.05 to 20.

The high-boiling organic solvents according to the present invention may be used alone or in combination, or they may be used together with other conventionally known high-boiling organic solvents in a range that attains the object of the present invention. As the conventionally known high-boiling organic solvents, for example, phosphate solvents, such as tricresyl phosphate, tri-2-ethylhexyl phosphate, 7-methyloctyl phosphate, and tricyclohexyl phosphate, and phenol solvents, such as 2,5-di-tert-amylphenol and 2,5-di-sec-amylphenol, can be mentioned.

Specific examples of the high-viscosity high-boiling organic solvents according to the present invention are listed below.

| Compound No. | Structural Formula | Remarks |
|---|---|---|
| S-1 | 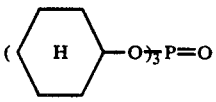 | Solid (m.p.*: 60° C.) |

-continued
| Compound No. | Structural Formula | Remarks |
|---|---|---|
| S-2 | $(ClCH_2\underset{\underset{Cl}{\vert}}{C}HCH_2O)_3P{=}O$ | Solid (m.p.: 26.8° C.) |
| S-3 | 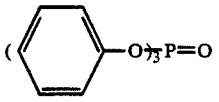 | Solid (m.p.: 48.5° C.) |
| S-4 | 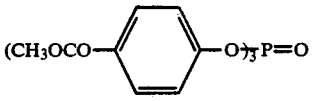 | Solid (m.p.: 101°~103° C.) |
| S-5 | 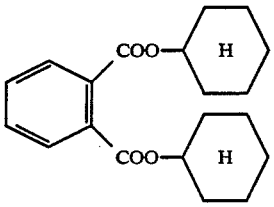 | Solid (m.p.: 58°~65° C.) |
| S-6 | 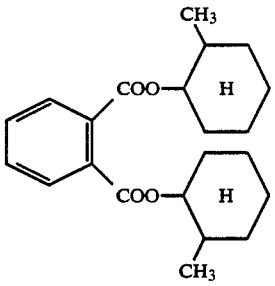 | Solid |
| S-7 | 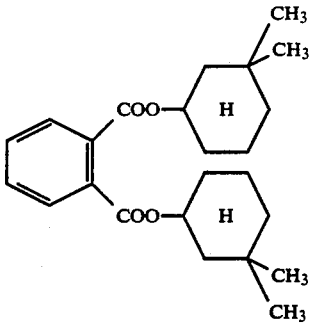 | Solid |
| S-8 | 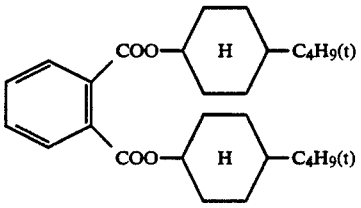 | Solid |

-continued
| Compound No. | Structural Formula | Remarks |
|---|---|---|
| S-9 | 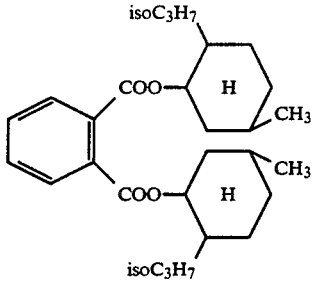 | Solid (m.p.: 29°~130° C.) |
| S-10 | 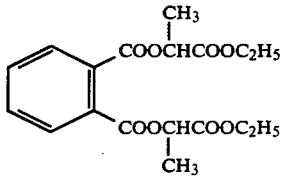 | Solid (m.p.*: 50°~53° C.) |
| S-11 | 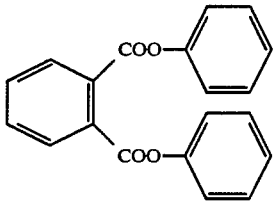 | Solid (m.p.: 69° C.) |
| S-12 | 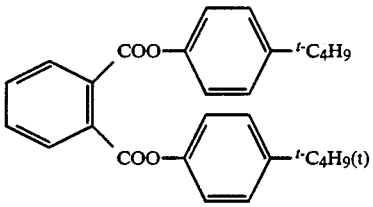 | Solid (m.p.: 142° C.) |
| S-13 | 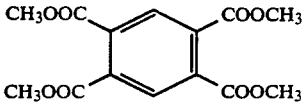 | Solid (m.p.: 144° C.) |
| S-14 | 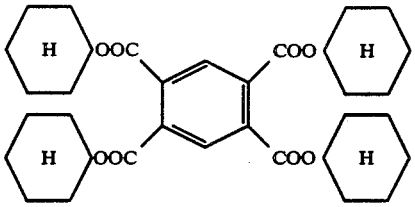 | Solid (m.p.: 148° C.) |
| S-15 | 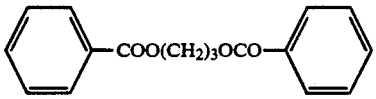 | Solid (m.p.: 47° C.) |
| S-16 | 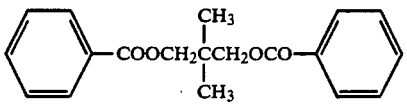 | Solid (m.p.: 49° C.) |
| S-17 | $(ClCH_2CHCH_2O)_3P{=}O$ (Cl) | 1500 cp |

-continued
| Compound No. | Structural Formula | Remarks |
|---|---|---|
| S-18 | 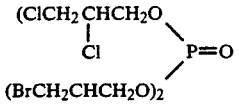 | 4260 cp |
| S-19 | 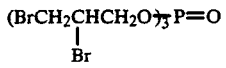 | 6810 cp |
| S-20 | 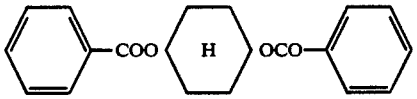 | Solid (m.p.*: 113° C.) |
| S-21 | 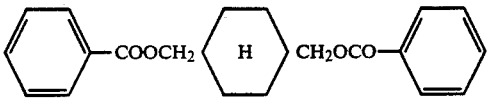 | Solid (m.p.: 24° C.) |
| S-22 | 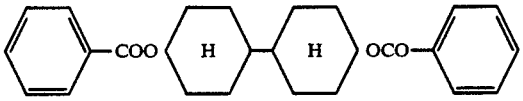 | Solid (m.p.: 194° C.) |
| S-23 | 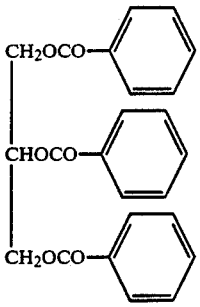 | Solid (m.p.: 71° C.) |
| S-24 | 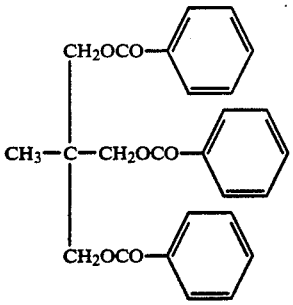 | Solid (m.p.: 81° C.) |
| S-25 | 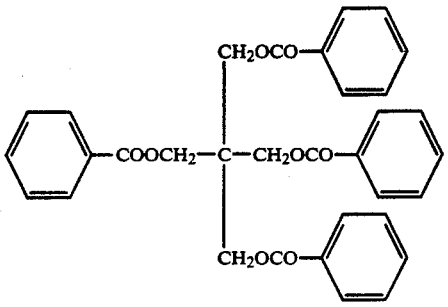 | Solid (m.p.: 99 |

-continued
| Compound No. | Structural Formula | Remarks |
|---|---|---|
| S-26 | 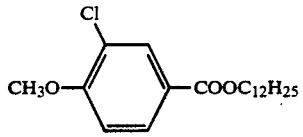 | Solid (m.p.: 43° C.) |
| S-27 | $C_{15}H_{31}COOC_{18}H_{37}$ | Solid (m.p.: 58° C.) |
| S-28 | n-$C_{17}H_{35}COOCH_3$ | Solid (m.p.: 38° C.) |
| S-29 | $C_{17}H_{35}COOC_{16}H_{33}$ | Solid (m.p.: 58° C.) |
| S-30 | $CH_2OCOC_{11}H_{23}$-n<br>\|<br>$CHOCOC_{11}H_{23}$-n<br>\|<br>$CH_2OCOC_{11}H_{23}$-n | Solid (m.p.*: 47° C.) |
| S-31 | 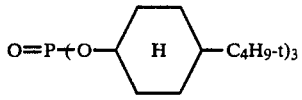 | Solid |
| S-32 | $O{=}P{-}(OC_{14}H_{29})_3$ | Solid |
| S-33 | $O{=}P{-}(OC_{16}H_{33})_3$ | Solid |
| S-34 | 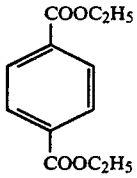 | Solid |
| S-35 | 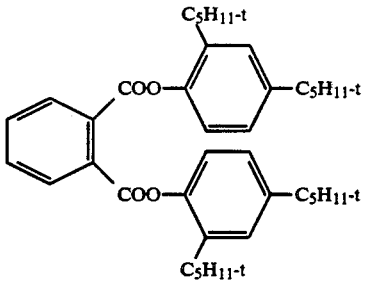 | Solid |
| S-36 | 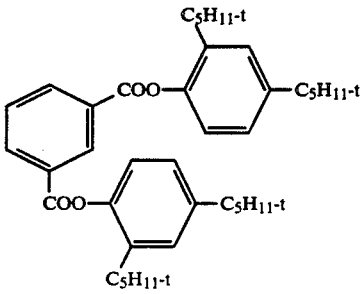 | Solid |

-continued
| Compound No. | Structural Formula | Remarks |
|---|---|---|
| S-37 | 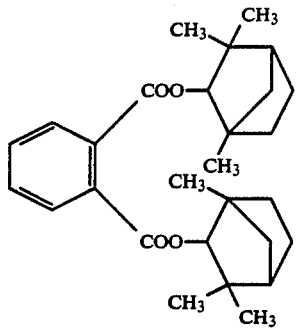 | Solid |
| S-38 | 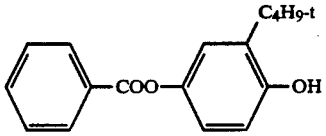 | Solid |
| S-39 | 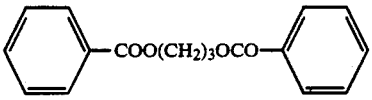 | Solid |
| S-40 | 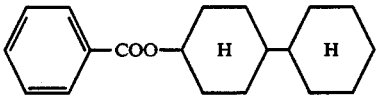 | Solid |
| S-41 | 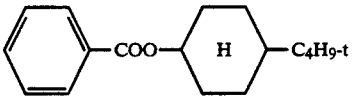 | Solid |
| S-42 | 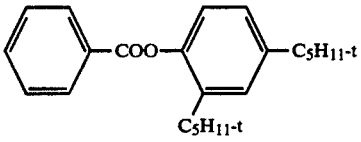 | Solid |
| S-43 | 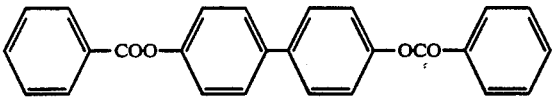 | Solid |
| S-44 | 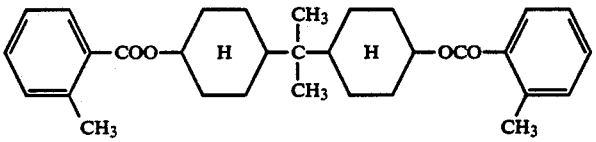 | Solid |
| S-45 | 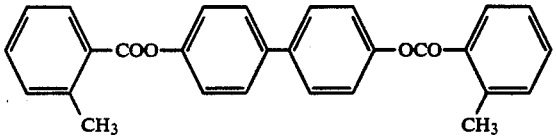 | Solid |
| S-46 | 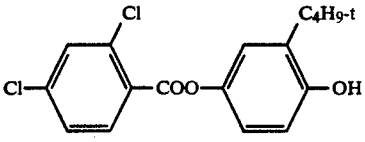 | Solid |

-continued
| Compound No. | Structural Formula | Remarks |
|---|---|---|
| S-47 | 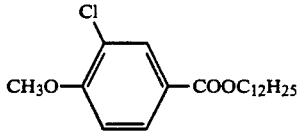 | Solid |
| S-48 | $C_{15}H_{31}COOC_{16}H_{33}$ | Solid |
| S-49 | $CH_2OCOC_{17}H_{35}$<br>\|<br>$CHOCOC_{17}H_{35}$<br>\|<br>$CH_2OCOC_{17}H_{35}$ | Solid |
| S-50 | $C_8H_{17}CH{=}CH(CH_2)_7CONH_2$ | Solid |
| S-51 | 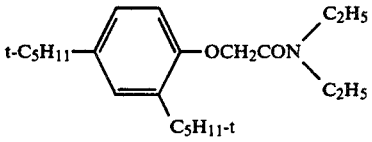 | Solid |
| S-52 | 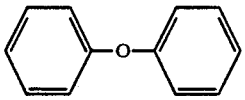 | Solid |
| S-53 | 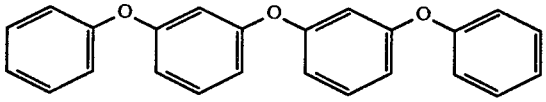 | Solid |
| S-54 | 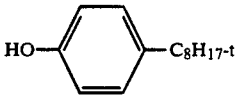 | Solid |
| S-55 | 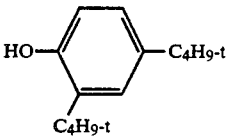 | Solid |
| S-56 | $C_{24}H_{29}Cl_{21}$ (Chlorinated Paraffin) | Solid |
| S-57 | 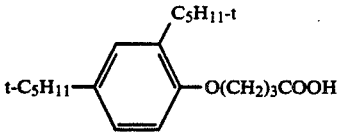 | Solid |
| S-58 | 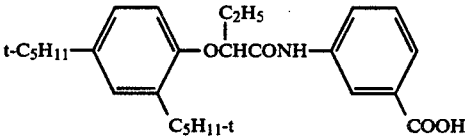 | Solid |
| S-59 | 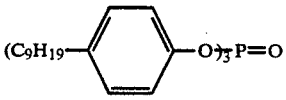 | 15,600 cp |
| S-60 | 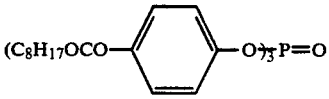 | 20,800 cp |

-continued

| Compound No. | Structural Formula | Remarks |
|---|---|---|
| S-61 | 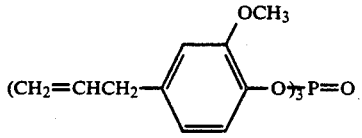 | 21,600 cp |
| S-62 | 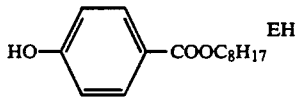 | 14,300 cp |
| S-63 | 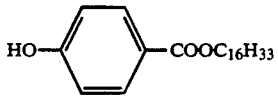 | Solid |

Note:
*m.p.: melting point

Of the compounds of formula ($III_5$), other preferable high-boiling organic solvents are represented by formulae ($III_5$-1) and ($III_5$-2).

Formula ($III_5$-1)

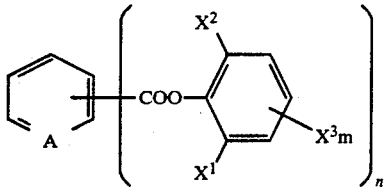

wherein A represents CH or N, $X^1$, $X^2$, and $X^3$ each represent independently —H, halogen, —R, —CH=NOR, —COR, —$SO_2$R, —YR, —YCOR, —COYR, —$YSO_2$R, or —$SO_2$YR, Y represents O, S or NR', R' represents H or R, two X's may together form a carbocyclic ring or a heterocyclic ring, R may be a substituted or unsubstituted alkyl group having 1 to 20 carbon atoms such as a methyl group, an ethyl group, an isopropyl group, an s-butyl group, a t-butyl group, a t-pentyl group, a 2-ethylhexyl group or an octadecyl group, a substituted or unsubstituted aryl group having 6 to 20 carbon atoms such as a phenyl group, a m-tolyl group, a p-tolyl group, a p-hydroxyphenyl group, or an α-naphthyl group, or a substituted or unsubstituted heterocyclic group having 2 to 20 carbon atoms such as a pyrazolyl group, a benzoxazolyl group, a benzothiazolyl, a benzotriazole group, or a phenyltetrazolyl group, n is 2, 3, or 4, and each m is 1, 2 or 3, provided that at least one pair of the substituent groups $X^1$ and $X^2$ bonded to the same benzene ring must contain two or more non-hydrogen atoms in all.

In the present invention, it is more preferable that n is 2 or 4, m is 1, A represents CH, $X^1$ represents an alkyl group having 1 to 6 carbon atoms, a heterocyclic group, or —$COR^1$ wherein $R^1$ represents phenyl or $COOR^2$ in which $R^2$ represents an alkyl group having 1 to 6 carbon atoms, $X^2$ represents H or an alkyl group having 1 to 6 carbon atoms, and $X^3$ represents H, a methoxy group, or an alkyl group having 2 to 6 carbon atoms.

It is particularly preferable that $X^1$ and $X^2$ each are a sterically bulky group.

Next, the special examples of compound represented by formula ($III_5$-1) for use in the present invention are described.

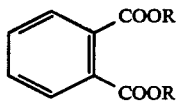

wherein R represents the followings:

(S-64)

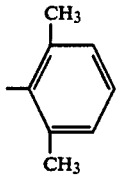

(S-65)

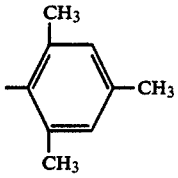

(S-66)

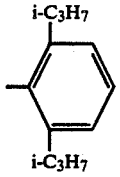

(S-67)

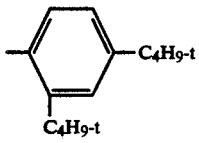

(S-68)

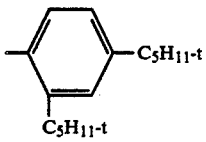

-continued
(S-69)
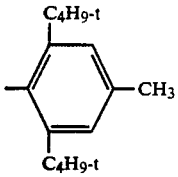
(S-70)
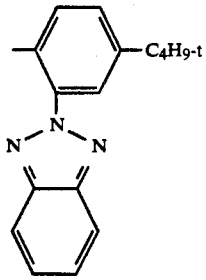
(S-71)
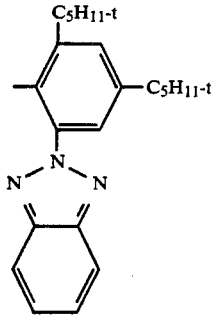
(S-72)
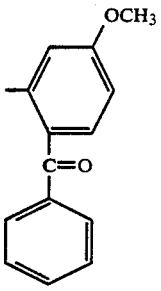
(S-73)
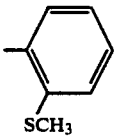
(S-74)
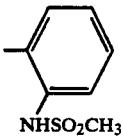
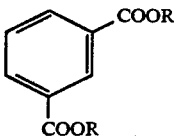
where R represents the followings:
(S-75)
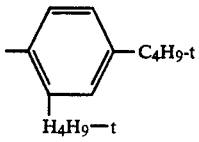
(S-76)
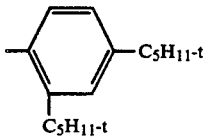
(S-77)
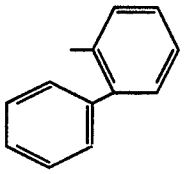
(S-78)
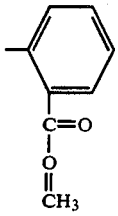
(S-79)
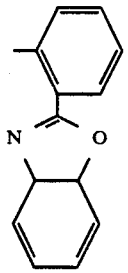
(S-80)
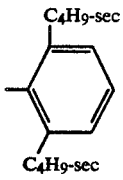
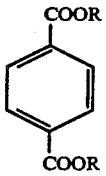
wherein R represents the followings:
(S-81)
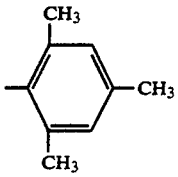

-continued
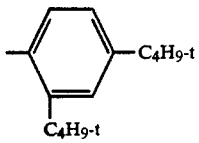
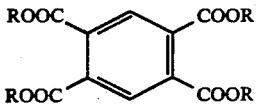
wherein R represents the followings:
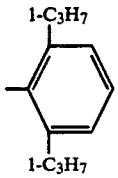
(S-83)
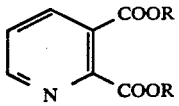
wherein R represents the followings:
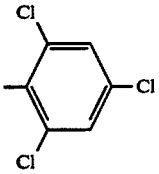
(S-84)
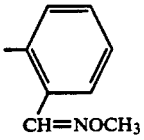
(S-85)
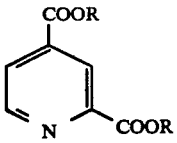
wherein R represents the followings:
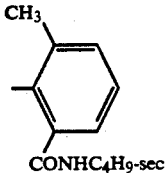
(S-86)
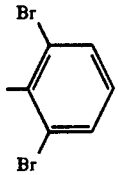
(S-87)
-continued
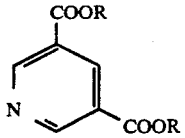
(S-88)
wherein R represents the followings:
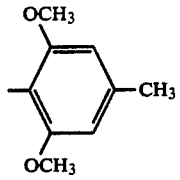
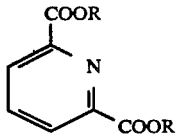
(S-89)
wherein R represents the followings:
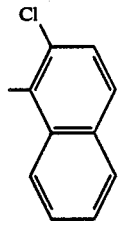
(S-90)
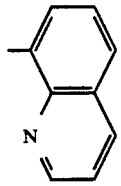
(S-91)
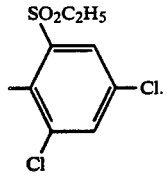
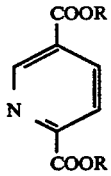
wherein R represents the followings:
(S-92)
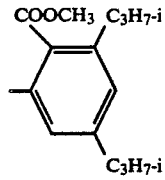

-continued (S-93)

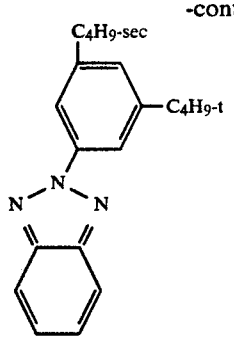

(S-94)

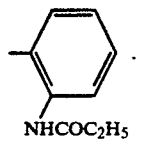

The compounds of the present invention can be commercially available and also can be synthesized, for example, by the method described in JP-A No. 134642/1987.

Formula ($III_5$-2) will now be described.

Formula ($III_5$-2)

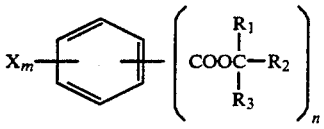

In formula ($III_5$-2), X represents a halogen atom (e.g., fluorine, chlorine, bromine, and iodine), an alkyl group having 1 to 20 carbon atoms, an alkoxy group having 1 to 20 carbon atoms, or an alkoxycarbonyl group having 2 to 21 carbon atoms, m is an integer of 0 to 5, $R_1$, $R_2$, and $R_3$ each represent independently a straight-chain or branched alkyl group having 1 to 12 carbon atoms, a cycloalkyl group having 3 to 12 carbon atoms, an aralkyl group having 7 to 20 carbon atoms, an aryl group having 6 to 20 carbon atoms, a heterocyclic group having 3 to 12 carbon atoms, n is an integer of 1 to 4, with the total of n and m being 6 or below, when m is 2 or over, groups X may be the same or different, when n is 2 or over, groups

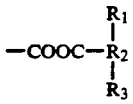

may be the same or different, $R_1$ may be a hydrogen atom, and $R_2$ and $R_3$ may together bond to form a ring.

Now, the compounds represented by formula ($III_5$-2) will be described in detail.

In formula ($III_5$-2), specific examples of X includes, in addition to the above halogen atoms, an alkyl group (e.g., methyl, ethyl, isopropyl, t-butyl, cyclopentyl, cyclohexyl, 2-ethylhexyl, dodecyl, benzyl, and trifluoromethyl), an alkoxy group (e.g., methoxy, ethoxy, 2-ethylhexyloxy, benzyloxy, dodecyloxy, and methoxyethoxy), and an alkoxycarbonyl group (e.g., methoxycarbonyl, ethoxycarbonyl, butoxycarbonyl, and hexadecyloxycarbonyl).

In formula ($III_2$-2), specific examples of $R_1$, $R_2$, and $R_3$ include a straight-chain or branched alkyl group (e.g., methyl, ethyl, trifluoromethyl, isopropyl, sec-butyl, n-propyl, n-butyl, isopentyl, isobutyl, sec-pentyl, isohexyl, and sec-decyl), a cycloalkyl group (e.g., cyclopropyl, cyclobutyl, cyclopentyl, cyclohexyl, 4-methylcyclohexyl, 4-methylcyclohexenyl, 4-t-butylcyclohexyl, cycloheptyl, menthyl, bornyl, bicyclo[2,2,1-]heptane-2-yl), an aralkyl group (e.g., benzyl, 4-methoxybenzyl, 1-naphthylmethyl, and phenethyl), an aryl group (e.g., phenyl, 4-methoxyphenyl, 2,4-dichlorophenyl, p-tolyl, and 1-naphthyl), and a heterocyclic group (e.g., furyl, thienyl, pyridyl, N-methylimidazolyl, N-methylpyrrolyl, tetrahydrofurfuryl, N-ethylindolyl, and quinolyl).

In formula ($III_5$-2), when $R_2$ and $R_3$ bond together to form a ring, for example, its examples include cyclopentyl, cyclohexyl, menthyl, fenchyl, bornyl, and bicyclo[2,2,1]heptane-2-yl.

Out of the compounds represented by formula ($III_5$-2), compounds that are used preferably in the present invention satisfy one of the following conditions (1) or (2):

(1) The total number of α-hydrogen atoms of $R_1$, $R_2$, and $R_3$ does not exceed 7.

(2) When $R_1$ is a hydrogen atom, one of the following (a) or (b) is satisfied:

(a) When $R_2$ and $R_3$ bond together to form a ring, the total number of α-hydrogen atoms of $R_2$ and $R_3$ does not (b) When $R_2$ and $R_3$ do not form a ring, the α-position of $R_2$ or $R_3$ is substituted by two different substituents.

More preferably, in the compounds represented by formula ($III_5$-2), m is 0 and n is 2, and particularly preferably the compounds are represented by the following formula ($III_5$-3) or ($III_5$-4):

Formula ($III_5$-3)

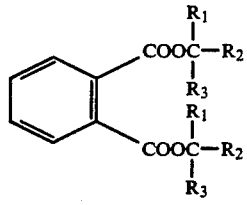

Formula ($III_5$-4)

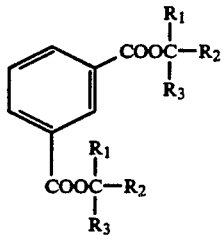

$R_1$, $R_2$, and $R_3$ in formulae ($III_5$-3) and ($III_5$-2) have the same meanings as those defined in formula ($III_5$-2).

Particularly preferably

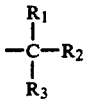

in formula ($III_5$-2) satisfies one of the following conditions (3) or (4).

(3) $R_1$, $R_2$, and $R_3$ are all alkyl groups (including cycloalkyl and aralkyl groups), provided that $R_1$, $R_2$, and $R_3$ are not methyl groups at the same time.

(4) $R_1$ is a hydrogen atom or an alkyl group, and $R_2$ and $R_3$ bond together to form a substituted or unsubstituted cyclohexane ring or cyclohexene ring.

Specific examples of

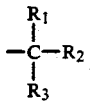

in formula ($III_5$-2) are given below.

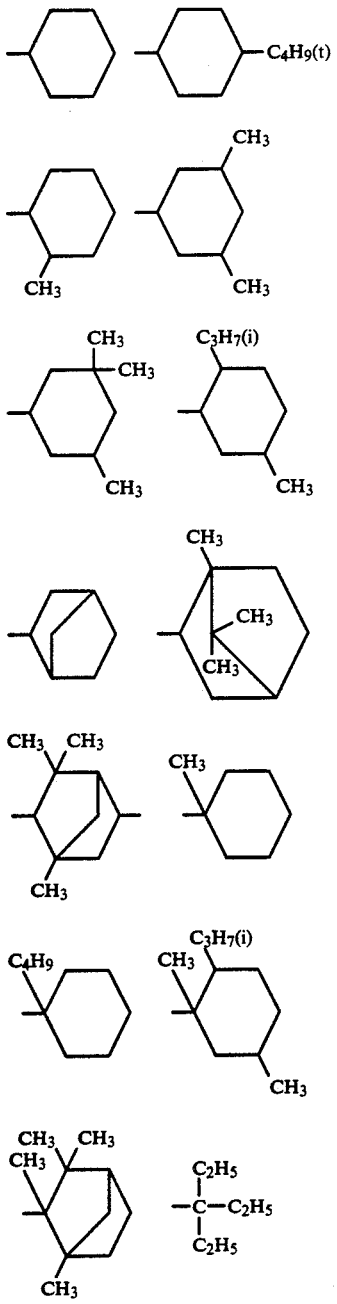

-continued

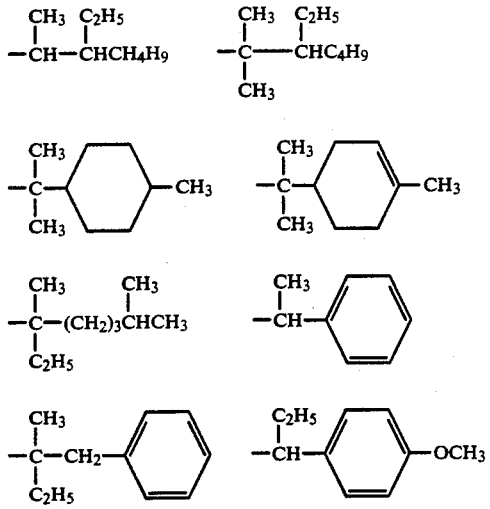

Specific examples of the compound represented by formula ($III_5$-2) are given below, but the present invention is not limited to them.

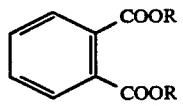

(S-95)

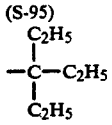

(S-96)

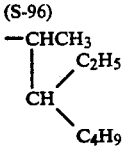

(S-97)

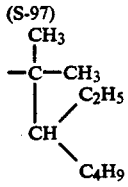

(S-98)

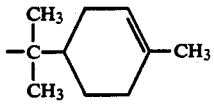

(S-99)

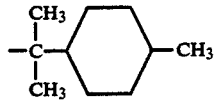

(S-100)

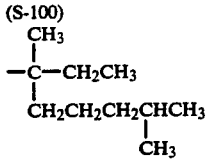

(S-101)

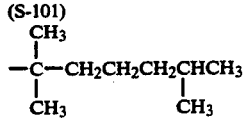

(S-102)

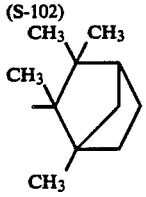

(S-103)

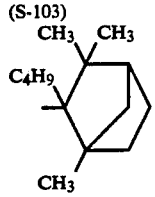

(S-104)

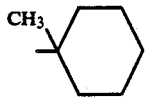

-continued
(S-105)
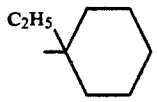
(S-106)
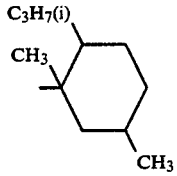
(S-107)
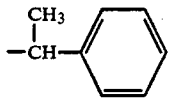
(S-108)
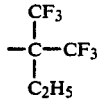
(S-109)
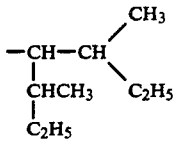
(S-110)
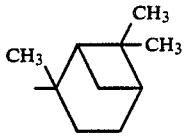
(S-111)
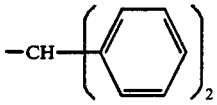
(S-112)
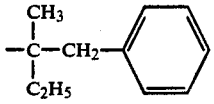
(S-113)
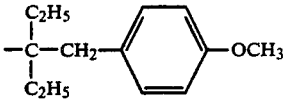
(S-114)
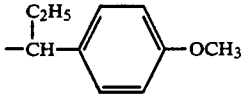
(S-115)
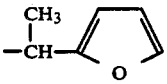
(S-116)
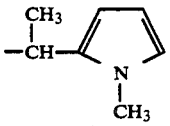
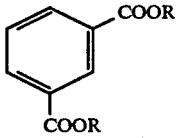
(S-117)
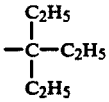
(S-118)
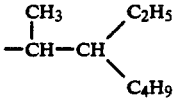
(S-119)
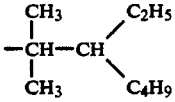
(S-120)
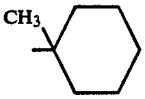
(S-121)
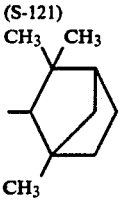
(S-122)
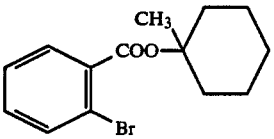
-continued
(S-123)
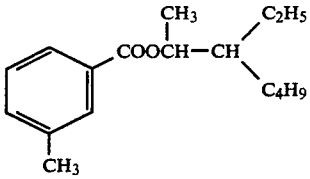
(S-124)
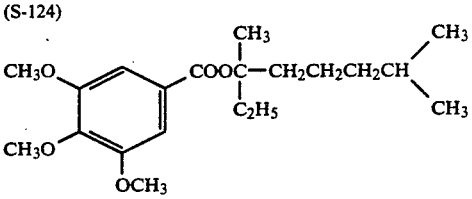
(S-125)
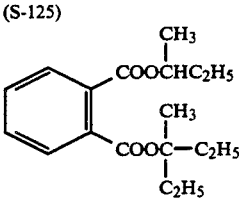
(S-126)
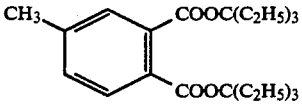
(S-127)
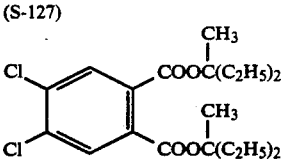
(S-128)
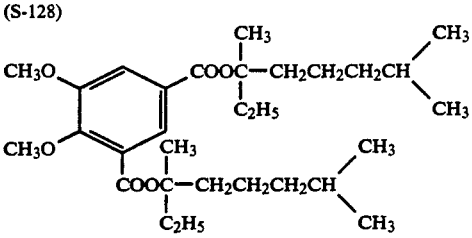
(S-129)
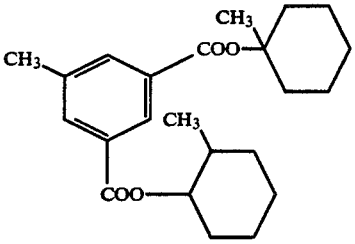
(S-130)
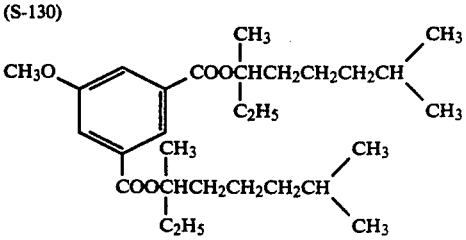

-continued
(S-131)
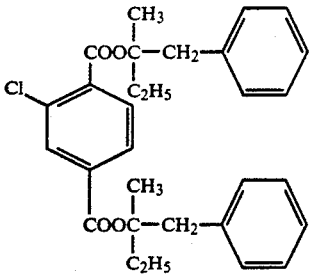
(S-132)
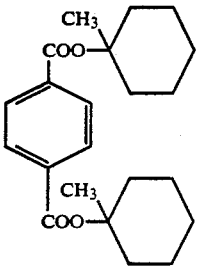
(S-133)
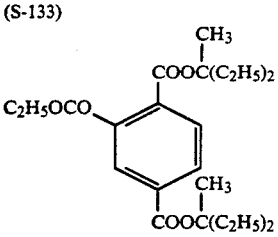
(S-134)
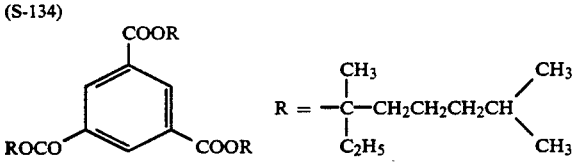
(S-135)
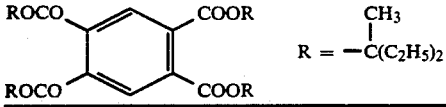
Besides the above, specific examples of the compound included in those represented by formula ($III_S$-2) that can be mentioned are as follows:
(S-136)
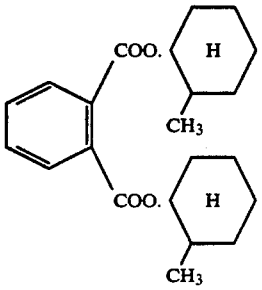
-continued
(S-137)
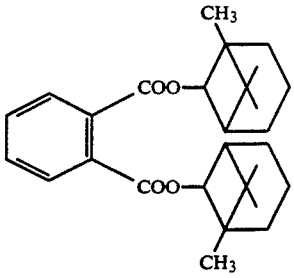
(S-138)
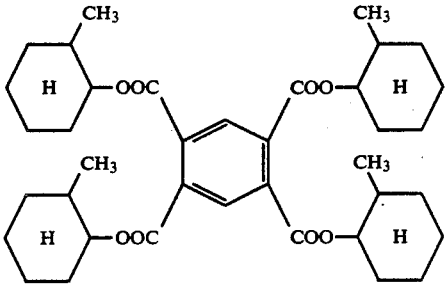
(S-139)
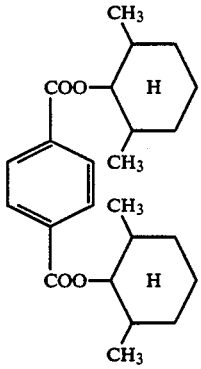
(S-140)
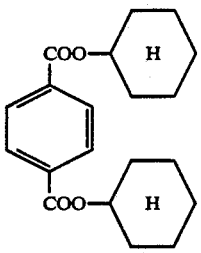
(S-141)
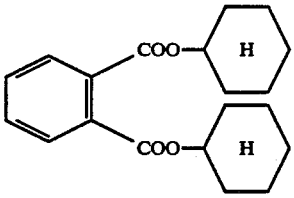
(S-142)
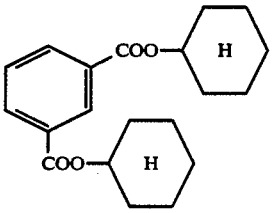

-continued (S-143)

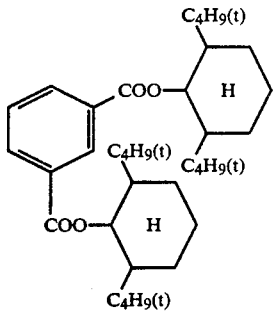

These compounds represented by formula ($III_5$-2) can be synthesized according to the following synthesis method:

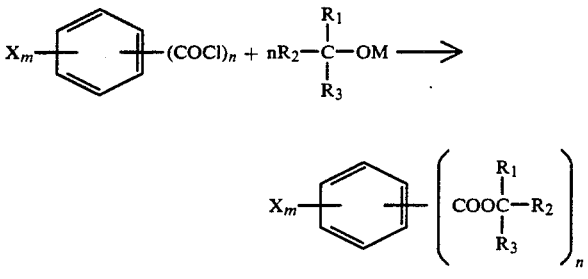

wherein M represents a hydrogen atom, Li, Na, or K. When M is a hydrogen atom, for example, pyridine, triethylamine, tetramethylguanidine, DBN, DBU, sodium carbonate, and potassium carbonate can be used as the base. As the reaction solvent, for example, acetonitrile, dimethylformamide, dimethylacetamide, N,N-dimethylimidazolidinone, sulfolane, dimethylsulfoxide, benzene, toluene, xylene, dioxane, and tetrahydrofuran are preferable.

Specific examples produced by this synthesis process are described, for example, in European Patent Application (EP) No. 228064.

As a reducing agent that can be used in the layer where the compound(s) of formula (II) and/or (III) of the present invention are present, the following compounds can be listed. These reducing agents are preferably used in an amount in the range of 0 to 20 mol%, more preferably 0 to 10 mol%, for the cyan coupler.

(X-1)

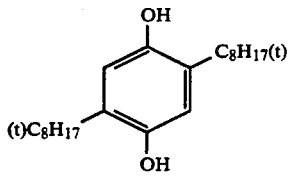

(X-2)

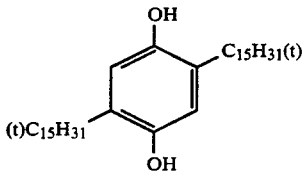

-continued (X-3)

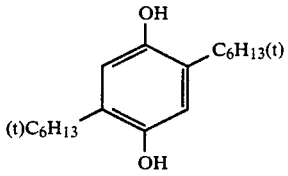

(X-4)

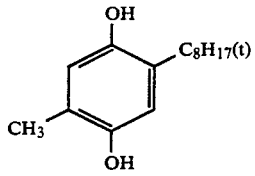

(X-5)

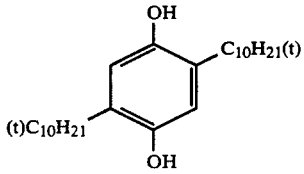

(X-6)

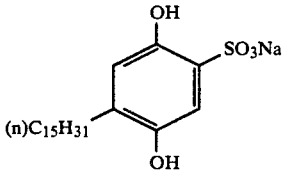

(X-7)

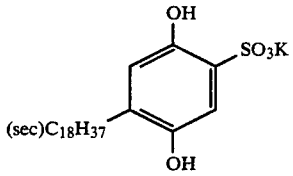

(X-8)

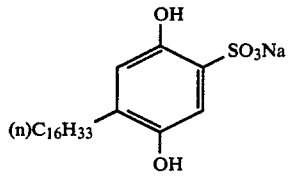

(X-9)

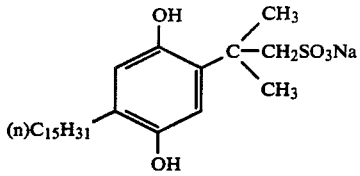

(X-10)

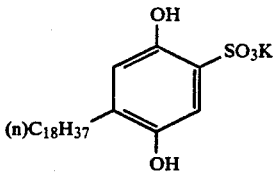

(X-11)

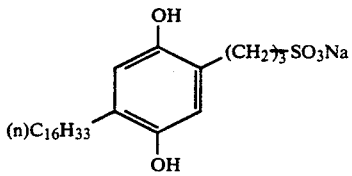

-continued
(X-12)
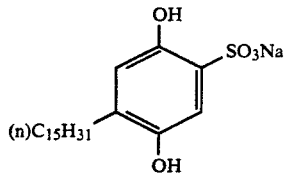
(X-13)
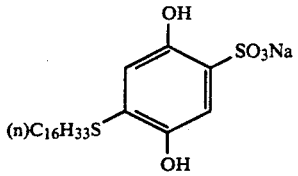
(X-14)
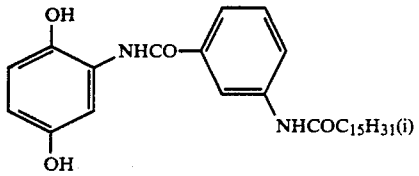
(X-15)
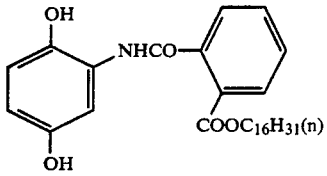
(X-16)
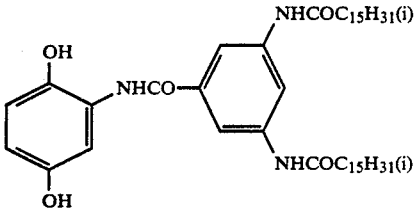
(X-17)
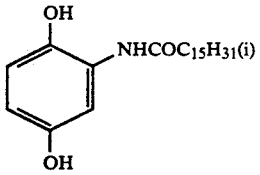
(X-18)
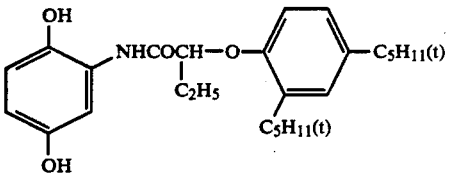
(X-19)
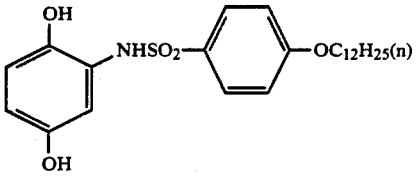
-continued
(X-20)
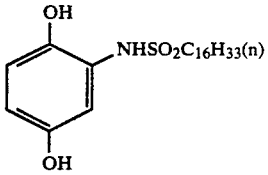
(X-21)
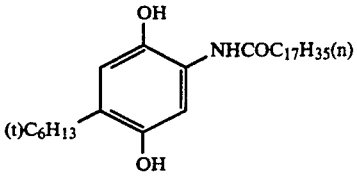
(X-22)
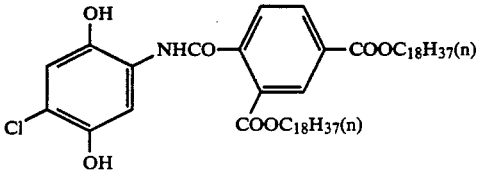
(X-23)
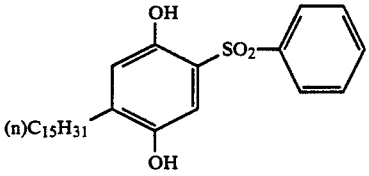
(X-24)
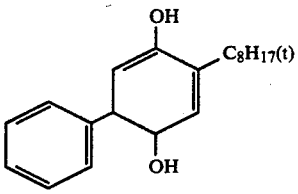
(X-25)
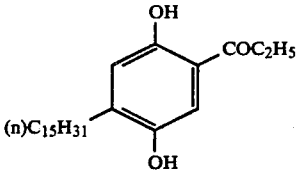
(X-26)
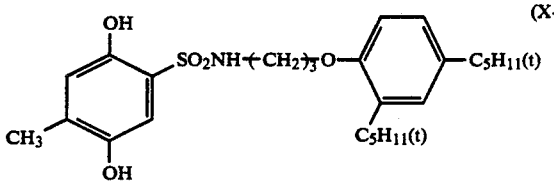
(X-27)
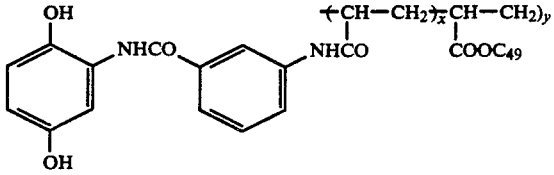
x:y = 2:5
Av. Molecular weight: About 20,000

-continued (X-28)

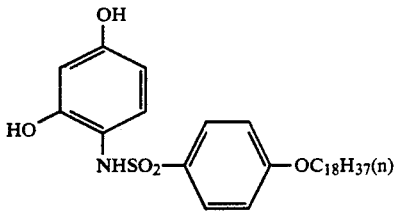

(X-29)

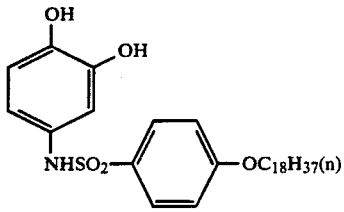

(X-30)

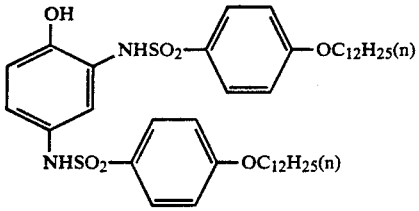

(X-31)

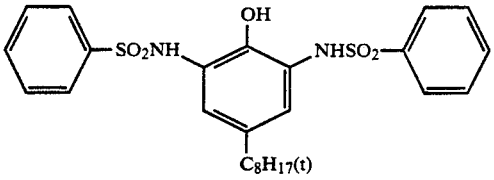

(X-32)

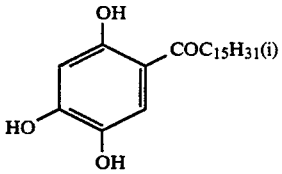

(X-33)

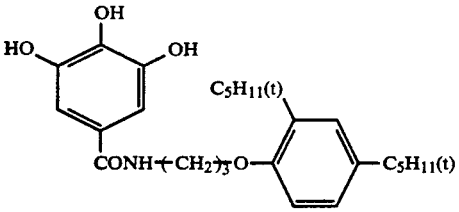

(X-34)

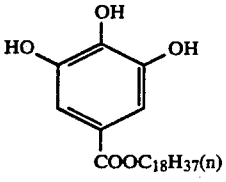

(X-35)

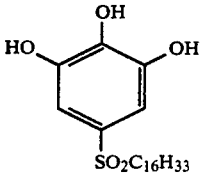

-continued (X-36)

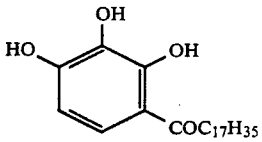

(X-37)

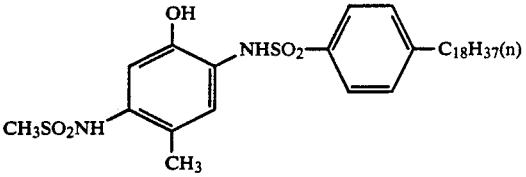

Preferable polymers used in the silver halide photographic material according to the present invention are those having a relative fluorescence efficiency K value of 0.10 or over, and more preferably 0.20 or over. The higher this value is, the better.

The above K value is the relative fluorescence efficiency of a compound A, in the polymer, which has the structure given below and is a kind of dye that is used a so-called fluorescence probe, and which is defined by the expression given below.

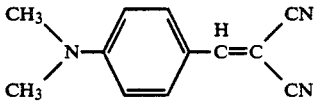

$K = \phi a/\phi b$ wherein $\phi a$ and $\phi b$ are respectively the fluorescence efficiencies of the compound A in polymer a and polymer b, and $\phi a$ and $\phi b$ are determined, for example, by following the method described in *Macromolecules*, 14, 587 (1981). Specifically, the value K was determined from $\phi a$ and $\phi b$ measured at room temperature by using the polymer thin film (note: the thickness of the thin film was adjusted by spin coating on a slide glass so that the absorbance of the compound A at $\lambda max$ might be 0.05 to 0.1). In the present invention, the K value was obtained using, as the polymer b, polymethyl methacrylate (having a number-average molecular weight of 20,000).

Specific examples of the polymer according to the present invention are listed and described below, but the present invention is not limited to them.

(A) Vinyl Polymers

As monomers that will form the vinyl polymer of the present invention, can be mentioned acrylates, specifically, methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, diemthylaminoethyl acrylate, benzyl acrylate, methoxybenzyl acrylate, 2-chlorocyclohexyl acrylate, cyclohexyl acrylate, furfuryl acrylate, tetrahydrofrufuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-iso-propoxy acrylate, 2-butoxyethyl acrylate, 2-(2-methoxyethoxy)ethyl acrylate, 2-(2-butoxyethoxy)ethyl acrylate, ω-methoxypolyethylene glycol acrylate (the adduct number=9), 1-bromo-2-methoxyethyl acrylate, and 1,1-dichloro-2-ethoxyethyl acrylate.

And the monomers described below can be used.

Methacrylates, for example, methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (the adduct number=6), allyl methacrylate, and methacrylic acid dimethylaminoethylmethyl chloride salt;

vinyl esters: for example, vinyl acetate, vinyl propionate, vinyl butylate, vinyl isobutylate, vinyl caproate, vinyl chloroacetate, vinyl methoxyacetate, vinyl phenylacetate, vinyl benzoate, and vinyl salicylate;

acrylamides: for example, methyl acrylamide, ethyl acrylamide, propyl acrylamide, butyl acrylamide, tert-butyl acrylamide, cyclohexyl acrylamide, benzyl acrylamide, hydroxymethyl acrylamide, methoxyethyl acrylamide, dimethylaminoethyl acrylamide, phenyl acrylamide, dimethyl acrylamide, diethyl acrylamide, β-cyanoethyl acrylamide, N-(2-acetoacetoxyethyl) acrylamide, diacetone acrylamide, and tert-octyl acrylamide;

methacrylamides: for example, methacrylamide, methyl methacrylamide, ethyl methacrylamide, propyl methacrylamide, butyl methacrylamide, tert-butyl methacrylamide, cyclohexyl methacrylamide, benzyl methacrylamide, hydroxymethyl methacrylamide, methoxyethyl methacrylamide, dimethylaminoethyl methacrylamide, phenyl methacrylamide, dimethyl methacrylamide, diethyl methacrylamide, β-cyanoethyl methacrylamide, and N-(2-acetoacetoxyethyl) methacrylamide;

olefins: for example, dicyclopentadiene, ethylene, propylene, 1-butene, 1-pentene, vinyl chloride, vinylidene chloride, isoprene, chloroprene, butadiene, and 2,3-dimethylbutadiene; styrenes such as styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, and vinyl benzoic acid methyl ester;

vinyl ethers: for example, methyl vinyl ether, butyl vinyl ether, hexyl vinyl ether, methoxy vinyl ether, and dimethylaminoethyl vinyl ether; and others: for example, butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalonitrile, and vinylidene.

With respect to the monomers used for the polymer of the present invention (e.g., the above-mentioned monomers), two or more monomers can be used as comonomers in relation to each other in accordance with various purposes (e.g., in order to improve the solubility). In order to adjust the color forming properties and the solubility, monomers having an acid group exemplified below as comonomers can be used in the range wherein the copolymer will not become insoluble in water:

acrylic acid; methacrylic acid; itaconic acid; maleic acid; monoalkyl itaconates such as monomethyl itaconate, monoethyl itaconate, and monobutyl itaconate; monoalkyl maleates such as monomethyl itaconate, monoethyl itaconate, and monobutyl itaconate; citraconic acid; styrenesulfonic acid; vinylbenzylsulfonic acid; vinylsulfonic acid; acryloyloxyalkylsulfonic acids such as acryloyloxymethylsulfonic acid, acryloyloxyethylsulfonic acid, and acryloyloxypropylsulfonic acid; methacryloyloxyalkylsulfonic acids such as methacryloyloxymethylsulfonic acid, methacryloyloxyethylsulfonic acid, and methacryloyloxypropylsulfonic acid; acrylamidoalkylsulfonic acids such as 2-acrylamido-2-methylethanesulfonic acid, 2-acrylamido-2-methylpropanesulfonic acid, and 2-acrylamido-2-methylbutanesulfonic acid; and methacrylamidoalkylsulfonic acids such as 2-methacrylamido-2-methylethanesulfonic acid, 2-methacrylamido-2-methylpropanesulfonic acid, and 2-methacrylamido-2-methylbutanesulfonic acid.

These acids may be in the form of salts of an alkali metal (e.g., Na and K) or ammonium ion(s).

When, from among the vinyl monomers mentioned above and other vinyl monomers used in the present invention, hydrophilic monomers (herein by "hydrophilic monomers" is meant monomers that the polymer obtained by homopolymerization the monomer is soluble in water.) are used as comonomers, there is no limit on the proportion of the hydrophilic monomer in the copolymer, unless the copolymer becomes insoluble in water, but generally the proportion of the hydrophilic monomer in the copolymer is preferably 40 mol% or below, more preferably 20 % or below, and further more preferably 10 mol% or below. Further, if the hydrophilic comonomer that will be copolymerized with the monomer of the present invention has an acid group, the proportion of the comonomer having an acid group in the copolymer is generally 20 mol% or below, preferably 10 mol% or below, and most preferably nil, in view of the image stability as stated above.

The monomer of the polymer of the present invention is preferably a methacrylate monomer, an acrylamide monomer, or a methacrylamide monomer, with particular preference given to an acrylamide monomer or a methacrylamide monomer.

(B) Polyester obtained by condensation polymerization or addition polymerization As polymers by condensation polymerization, polyester obtained from polyhydric alcohol and polybasic acid and polyamide obtained from diamine and dibasic acid or ω-amino-ω'-carbonic acid are generally known, and as polymers by addition polymerization, polyurethane obtained from diisocyanate and dihydric alcohol or the like is known.

As polyhydric alcohols, glycols having the structure of HO-$R_1$-OH (wherein $R_1$ represents a hydrocarbon chain, particularly an aliphatic hydrocarbon chain, having about 2 to about 12 carbon atoms) or polyalkylene glycols are effective, and as polybasic acids, HOO-C—$R_2$—COOH (wherein $R_2$ represents simply a bond or a hydrocarbon chain having 1 to about 12 carbon atoms) is effective.

As specific examples of the polyhydric alcohols, can be mentioned ethylene glycol, diethylene glycol, triethylene glycol, 1,2-propylene glycol, 1,3-propylene glycol, trimethylolpropane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerine, diglycerine, triglycerine, 1-methylglycerine, erythrite, mannitol, and sorbitol.

As specific examples of the polybasic acids, can be mentioned oxalic acid, succinic acid, glutaric acid, adipic acid, pimelic acid, cork acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, metaconic acid, isopimelic acid, cyclopentadiene/maleic anhydride adduct, and rosin/-maleic anhydride adduct.

As specific examples of the diamine, can be mentioned hydrazine, methylenediamine, ethylenediamine, trimethylenediamine, tetramethylenediamine, hexamethylenediamine, dodecylmethylenediamine, 1,4-diaminocyclohexane, 1,4-diaminomethylcyclohexane, o-aminoaniline, p-aminoaniline, 1,4-diaminomethylbenzene, and di(4-aminophenyl)ether.

As specific examples of $\omega$-amino-$\omega'$-carbonic acid, can be mentioned glycine, $\beta$-alanine, 3-aminopropanoic acid, 4-aminobutanoic acid, 5-aminopentanoic acid, 11-(aminoethyl)benzoic acid, and 4-(4-aminophenyl)butanoic acid.

As specific examples of diisocyanate, can be mentioned ethylene diisocyanate, hexamethylene diisocyanate, m-phenylene diisocyanate, p-phenylene diisocyanate, p-xylene diisocyanate, and 1,5-naphtyldiisocyanate.

(C) Others

For example, a polyester obtained by ring opening polymerization as follows:

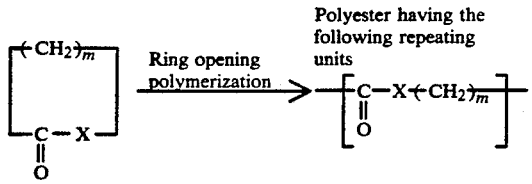

wherein X represents —O— or —NH—, m is an integer of 4 to 7, and the group —$CH_2$— may be branched.

Suitable monomers that can be used for producing the above polyester include, for example, $\beta$-propiolactone, $\epsilon$-caprolactone, dimethylpropiolactone, $\alpha$-pyrrolidone, $\alpha$-piperidone, $\epsilon$-caprolactam, and $\alpha$-methyl-$\delta$-caprolactam.

Further, a polymer represented by the following formula can be used:

$$\{(A)(B)\}_n$$

wherein A represents a repeating unit having, in the main chain, at least one bond selected from an ether linkage and —$SO_2$— linkage; B represents a repeating unit having, in the main chain, at least one bond selected from a linkage $$-\underset{\underset{O}{\|}}{C}-\underset{\underset{R}{|}}{N}-,$$

an ether lingage, a linkage $$-\underset{\underset{R}{|}}{N}-\underset{\underset{O}{\|}}{C}-O-,$$

a linkage —$SO_2$—, an ester linkage, or a single bond, and it may be the same as A; R represents a hydrogen atom, an alkyl group, an aryl group, or an aralkyl group that may be substituted; and n is an integer of 5 or over.

Two or more of the above polymers of the present invention may be optionally used in combination.

As the polymer of the present invention, vinyl polymers are preferable above all, acrylic polymers are more preferable, and acrylamide polymers are particularly preferable.

Although the molecular weight and the polymerization degree of the polymers of the present invention do not influence substantially the effect of the present invention, as the molecular weight increases, it takes a longer time to dissolve the polymer in a co-solvent, and also it becomes difficult to emulsify and disperse it, since the solution viscosity becomes high, so that coarse particles may be formed, and as a result such problems are liable to occur that the color-forming properties lower and the coarse particles cause the coatability to be defective. To solve these problems, if the co-solvent is used in a larger amount, to lower the viscosity of the solution, a new problem will arise in the process. Taking the above into consideration, preferably the viscosity of the polymer is such that when 30 g of the polymer is dissolved in 100 m of a co-solvent, the viscosity is 5,000 cps or below and more preferably 2,000 cps or below. Preferably the molecular weight of the polymer that can be used in the present invention is 150,000 or below, and more preferably 100,000 or below.

In the present invention, by "water-insoluble polymers" is meant polymers whose solubility is such that 3 g or below, preferably 1 g or below, of the polymer are soluble per 100 g of distilled water.

The addition of water-insoluble polymer improves synergistically the inhibiting effect to blix fading.

The ratio of the polymer of the present invention to the co-solvent will change depending on the type of polymer to be used and will vary over a wide range depending, for example, on the solubility in the co-solvent, the polymerization degree of the polymer, and the solubility of the coupler. Generally, a co-solvent is used in an amount required to make the solution consisting of at least the coupler, the high-boiling coupler solvent, and the polymer in the co-solvent have a viscosity low enough to allow the solution to be easily dispersed in water or an aqueous hydrophilic colloid solution. The higher the polymerization degree of a polymer is, the higher the viscosity of the solution is, and therefore, although it is difficult to determine absolutely the proportion of polymers to a particular co-solvent without considering the type of the polymer, generally preferably the weight ratio is in the range of about 1:1 to 1:50. Preferably the weight ratio of the polymer of the present invention to the coupler is 1:20 to 20:1, and more preferably 1:10 to 10:1.

Some specific examples of the polymer used in the present invention are given below, but the present invention is not limited to them.

P-1) poly(methyl methacrylate)
P-2) poly(ethyl methacrylate)
P-3) polyisopropyl methacrylate
P-4) polymethyl chloroacrylate
P-5) poly(2-tert-butylphenyl acrylate)
P-6) poly(4-tert-butylphenyl acrylate)
P-7) ethyl methacrylate/n-butyl acrylate copolymer (70:30)
P-8) methyl methacrylate/acrylonitrile copolymer (65:35)
P-9) methyl methacrylate/styrene copolymer (90:10)
P-10) N-tert-butyl methacrylamide/methyl methacrylate/acrylic acid copolymer (60:30:10)
P-11) methyl methacrylate/styrene/vinyl sulfonamide copolymer (70:20:10)
P-12) methyl methacrylate/cyclohexyl methacrylate copolymer (50:50)
P-13) methyl methacrylate/acrylic acid copolymer (95:5)
P-14) methyl methacrylate/n-butyl methacrylate copolymer (65:35)
P-15) methyl methacrylate/N-vinyl-2-pyrrolidone copolymer (90:10)
P-16) poly(N-sec-butyl acrylamide)
P-17) poly(N-tert-butyl acrylamide)
P-18) polycyclohexyl methacrylate/methyl methacrylate copolymer (60:40)
P-19) n-butyl methacrylate/methyl methacrylate/acrylamide copolymer (20:70:10)
P-20) diacetone acrylamide/methyl methacrylate copolymer (20:80)
P-21) N-tert-butyl acrylamide/methyl methacrylate copolymer (40:60)
P-22) poly(N-n-butyl acrylamide)
P-23) tert-butyl methacrylate/N-tert-butyl acrylamide copolymer (50:50)
P-24) tert-butyl methacrylate/methyl methacrylate copolymer (70:30)
P-25) poly(N-tert-butyl methacrylamide)
P-26) N-tert-butyl acrylamide/methyl methacrylate copolymer (60:40)
P-27) methyl methacrylate/acrylonitrile copolymer (70:30)
P-28) methyl methacrylate/styrene copolymer (75:25)
P-29) methyl methacrylate/hexyl methacrylate copolymer (70:30)
P-30) poly(4-biphenyl acrylate)
P-31) poly(2-chlorophenyl acrylate)
P-32) poly(4-chlorophenyl acrylate)
P-33) poly(pentachlorophenyl acrylate)
P-34) poly(4-ethoxycarbonylphenyl acrylate)
P-35) poly(4-methoxycarbonylphenyl acrylate)
P-36) poly(4-cyanophenyl acrylate)
P-37) poly(4-methoxyphenyl acrylate)
P-38) poly(3,5-dimethyladamantyl acrylate)
P-39) poly(3-dimethylaminophenyl acrylate)
P-40) poly(2-naphthyl acrylate)
P-41) poly(phenyl acrylate)
P-42) poly(N,N-dibutyl acrylamide)
P-43) poly(isohexyl acrylamide)
P-44) poly(isooctyl acrylamide)
P-45) poly(N-methyl-N-phenyl acrylamide)
P-46) poly(adamantyl methacrylate)
P-47) poly(sec-butyl methacrylate)
P-48) N-tert-butyl acrylamide/acrylic acid copolymer (97:3)
P-49) poly(2-chloroethyl methacrylate)
P-50) poly(2-cyanoethyl methacrylate)
P-51) poly(2-cyanomethylphenyl methacrylate)
P-52) poly(4-cyanophenyl methacrylate)
P-53) poly(cyclohexyl methacrylate)
P-54) poly(2-hydroxypropyl methacrylate)
P-55) poly(4-methoxycarbonylphenyl methacrylate)
P-56) poly(3,5-dimethyladamantyl methacrylate)
P-57) poly(phenyl methacrylate)
P-58) poly(4-butoxycarbonylphenyl methacrylamide)
P-59) poly(4-carboxyphenyl methacrylamide)
P-60) poly(4-ethoxycarbonylphenyl methacrylamide)
P-61) poly(4-methoxycarbonylphenyl methacrylamide)
P-62) poly(cyclohexyl chloroacrylate)
P-63) poly(ethyl chloroacrylate)
P-64) poly(isobutyl chloroacrylate)
P-65) poly(isopropyl chloroacrylate)

Synthesis Example (1)

Synthesis of methyl methacrylate polymer (P-3)

500 g of methyl methacrylate, 0.5 g of sodium polyacrylate, and 200 ml of distilled water were charged into a 500 ml three-necked flask and heated to 80° C. under a flow of nitrogen with stirring. 500 mg of dimethyl azo-bis-isolactate as a polymerization initiator was added to start polymerization.

After two hours of polymerization, the polymeric liquid was cooled, and the polymer, in the form of beads, was filtered and washed with water, to produce 48.7 g of P-3.

Synthesis Example (2)

Synthesis of t-butyl acrylamide polymer (P-17)

A mixture of 500 g of t-butyl acrylamide and 250 m of toluene was charged into a 500 ml three-necked flask and heated to 80° C. under a flow of nitrogen with stirring. Then, as a polymerization initiator, 10 ml of a toluene solution containing 500 ml of azo-bis-isobutyronitrile was added to start polymerization.

After 3 hours of polymerization, the polymeric liquid was cooled and poured into 1 l of hexane, and the deposited solid was filtered, washed with hexane, and heated under reduced pressure with stirring, to obtain 47.9 g of P-17.

The average particle diameter of lipophilic fine particles containing the compound(s) of formula (II) and/or formula (III) of the present invention, the coupler, the high-boiling coupler solvent, and the polymer, is in the range of 0.18 μm to 0.35 μm. When the average particle diameter is too large, the effect of color forming becomes low, and when the average particle diameter is too small, the inhibiting of blix fading becomes unsatisfactory. The dispersion of the above mentioned lipophilic fine particles is prepared in the following manner.

The polymer of the present invention that has been synthesized by a solution polymerization process, emulsion polymerization, suspension polymerization, or the like, and that is an uncrosslinked so-called linear polymer, the compound(s) of formula (II) and/or formula (III), the high-boiling coupler solvent, and the coupler are dissolved completely in an organic co-solvent, then the obtained solution is dispersed as fine particles into water, preferably into an aqueous hydrophilic colloid solution, and more preferably into an aqueous gelatin solution, by means of ultrasonic waves, a colloid mill, or the like, with the aid of a dispersant, and the dispersion is incorporated into a silver halide emulsion. Alternatively, it is also possible that water or an aqueous hydrophilic colloid solution, such as an aqueous gelatin solution, is added into an organic co-solvent containing a dispersing agent such as a surface-active agent, the polymer of the present invention, the compound(s) of formula (II) and/or formula (III), the high-boiling coupler solvent, and the coupler, to cause phase reversal so that an oil-in-water dispersion may be formed. After the organic co-solvent may be removed from the thus prepared dispersion by means, for example, of distillation, noodle washing, or ultrafiltration, the dispersion may be mixed with a photographic emulsion. Herein the term "organic co-solvent" means organic solvents useful at the time of emulsification and dispersion, which solvents will eventually be removed substantially from the photographic material during the drying step after coating, or, for example, by the above means; they have a low boiling point and a certain extent of solubility in water, and can be removed by washing with water or the like. As the organic co-solvent, acetates of lower alcohols, such as ethyl acetate and butyl acetate, ethyl propionate, secondary butyl alcohol, methyl ethyl ketone, methyl isobutyl ketone, $\beta$-ethoxyethyl acetate, methyl "Cellosolve" acetate, methyl "Carbitol" acetate, methyl "Carbitol" propionate, and cyclohexane can be exemplified Further, if required, an organic solvent completely compatible with water, such as methyl alcohol, ethyl alcohol, acetone, and tetrahydrofuran, can be used partly in addition.

In the color photographic material of the present invention, in addition to the above cyan coupler, a yellow coupler and a magenta coupler may be contained.

In the present invention, a blue-sensitive silver halide emulsion layer of the silver halide photographic material contains lipophilic fine particles (A) containing a yellow dye-forming coupler, a green-sensitive silver halide emulsion layer of the silver halide photographic material containing lipophilic fine particles (B) containing a magenta dye-forming coupler, and the average particle diameter of both the lipophilic fine particles (A) and (B) is 0.25 $\mu$m or less, preferably 0.18 $\mu$m to 0.25 $\mu$m. When the average diameter of these lipophilic fine particles is over 0.25 $\mu$m, the effect of color forming is lowered.

As the yellow coupler, pivaloylacetoanilide couplers described, for example, in U.S. Pat. Nos. 4,622,287 and 4,623,616, and benzoylacetoanilide couplers described in U.S. Pat. Nos. 3,408,194, 3,933,501, 4,046,575, 4,133,958, and 4,401,752, are preferably used, with preference given to the former in view of fastness of the color-formed image. In particular, couplers having a nitrogen coupling split-off-type coupling split-off group are preferable because they are highly active (i.e., high in color-forming properties).

As the magenta coupler, 3-anilino-5-pyrazolone couplers, 3-acylamino-5-pyrazolone couplers, and pyrazolonetriazole couplers are preferably used.

Of the pyrazoloazole couplers, imidazo[1,2-b]pyrazoles described in U.S. Pat. No. 4,500,630 are preferable, and pyrazolo[1,5-b][1,2,4]triazoles are particularly preferable, in view of reduced yellow subsidiary absorption of the color-formed dye and light fastness.

In addition, it is preferable to use pyrazolotriazole couplers wherein a branched alkyl group is attached to the 2-, 3-, or 6-position of the pyrazolotriazole ring, as described in JP-A No. 65245/1986, pyrazoloazole couplers that contain a sulfonamide group in the molecule, as described in JP-A No. 65246/1986, pyrazoloazole couplers that have an alkoxyphenylsulfonamide ballasting group, as described in JP-A No. 147254/1986, and pyrazolotriazole couplers having an alkoxy group or an aryloxy group in the 6-position, as described in European Patent (publication) No. 226,849.

It is further preferable, to use o-aminophenylthio coupling split-off 5-pyrazolone magenta couplers, as described in WO 88/04795.

Specific examples of the oil-soluble magenta and yellow couplers that can be used in the present invention are listed below, but the present invention is not limited to them.

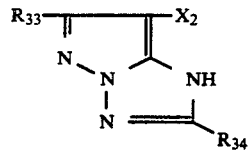

| Compound | $R_{33}$ | $R_{34}$ | $X_z$ |
|---|---|---|---|
| M-1 | $CH_3$— | 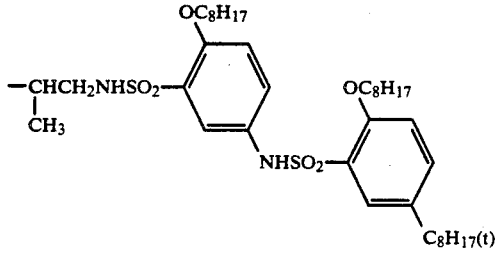 | Cl |

-continued
| | | | |
|---|---|---|---|
| M-2 | The same as the above | 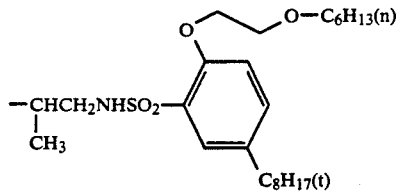 | The same as the above |
| M-3 | The same as the above | 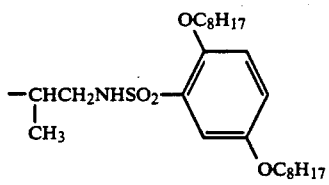 | 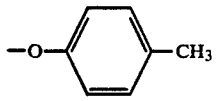 |
| M-4 | 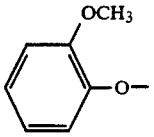 | 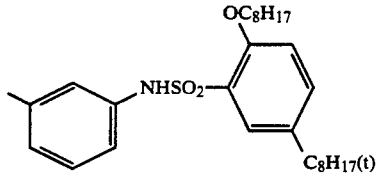 | 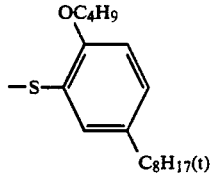 |
| M-5 | $CH_3$— | 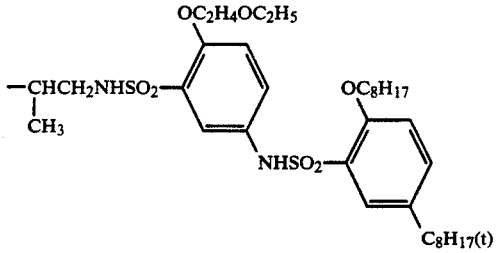 | Cl |
| M-6 | The same as the above | 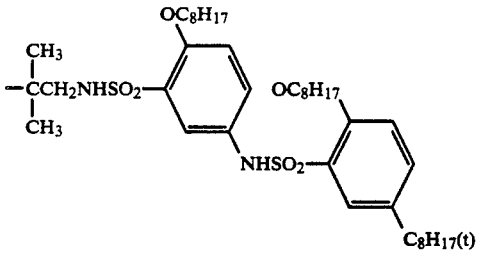 | The same as the above |
| M-7 | 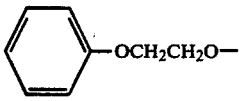 | 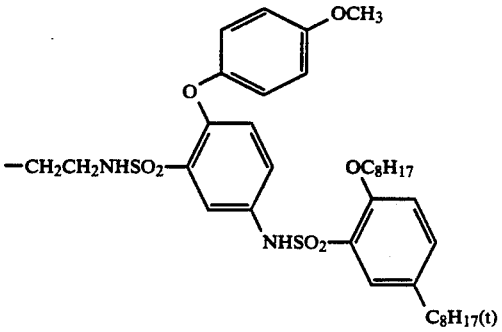 | 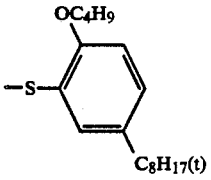 |
| M-8 | $CH_3CH_2O$— | The same as the above | The same as the above |

-continued
| | | | |
|---|---|---|---|
| M-9 | 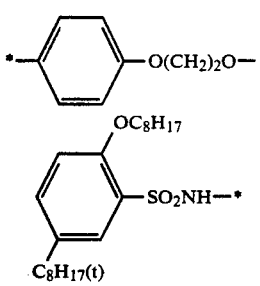 | 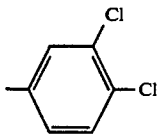 | The same as the above |
| M-10 | 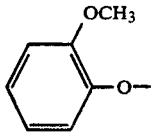 | 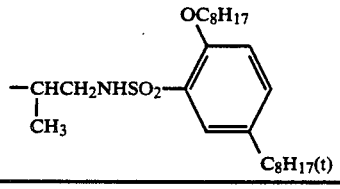 | Cl |
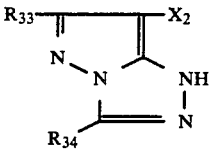
| Compound | $R_{33}$ | $R_{34}$ | $X_2$ |
|---|---|---|---|
| M-11 | $CH_3$— | 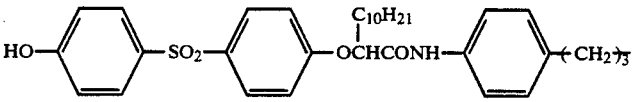 | Cl |
| M-12 | The same as the above | 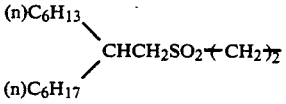 | The same as the above |
| M-13 | 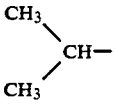 | 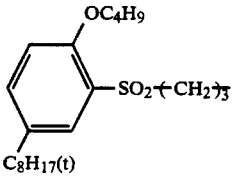 | The same as the above |
| M-14 | 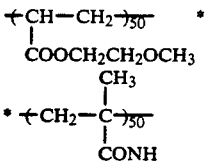 | 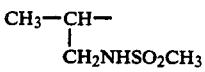 | The same as the above |
| M-15 | 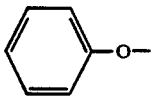 | 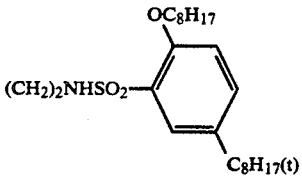 | Cl |
| M-16 | 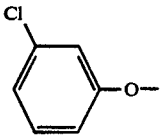 | 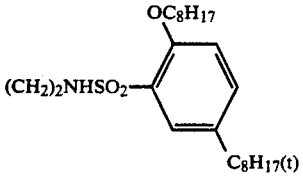 | 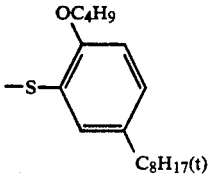 |

-continued
(M-17)
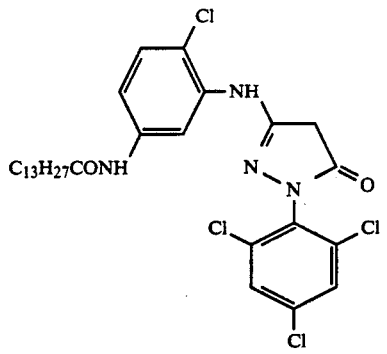
(M-18)
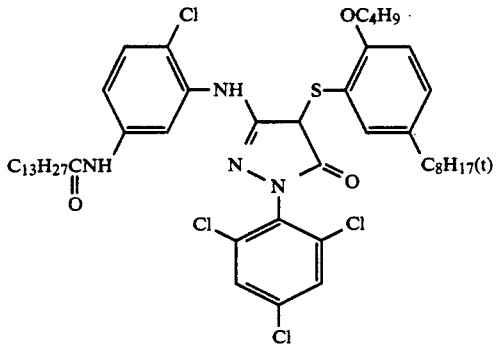
(M-19)
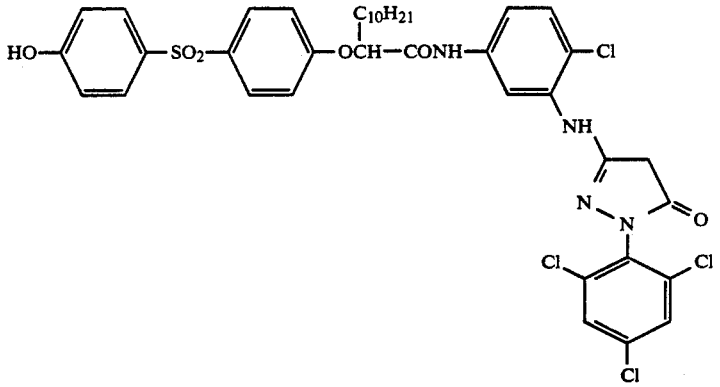
(M-20)
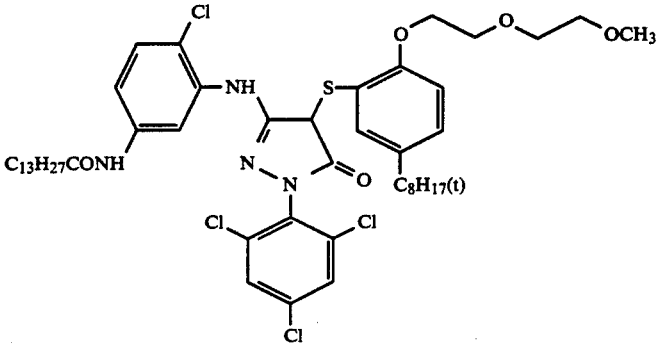

-continued
(M-21)
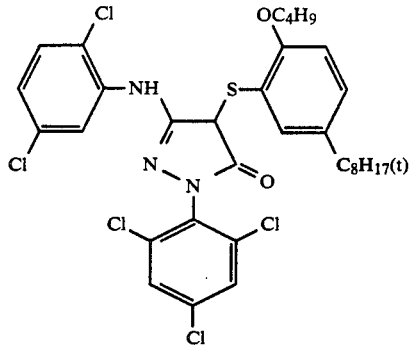
(M-22)
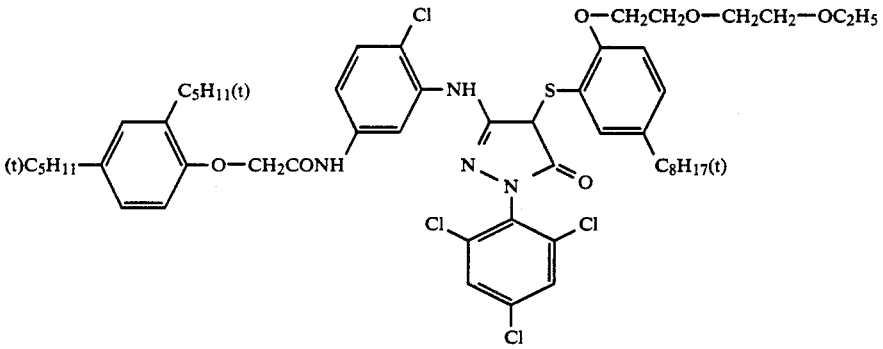
(M-23)
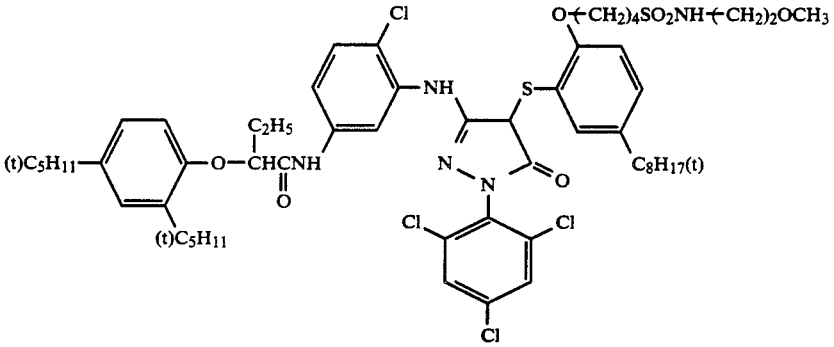
(M-24)
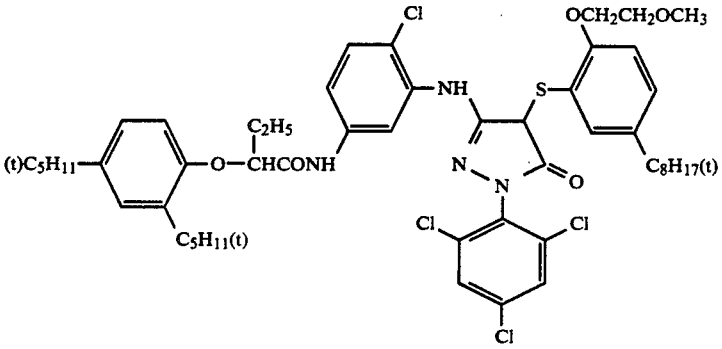

-continued
(M-25)
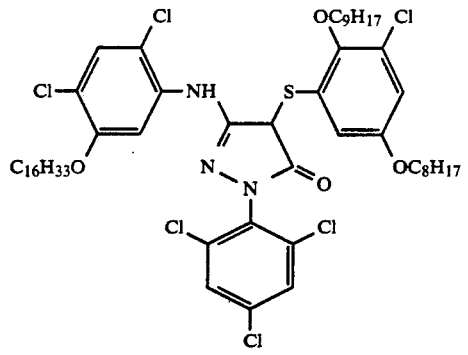
(M-26)
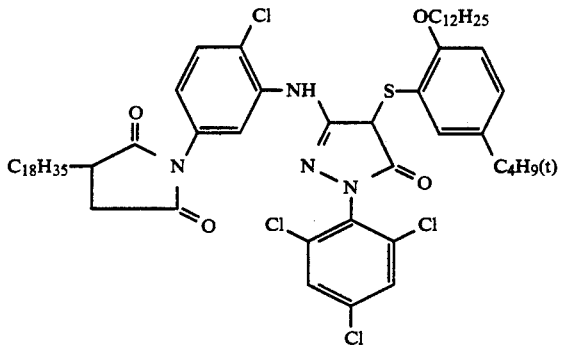
(M-27)
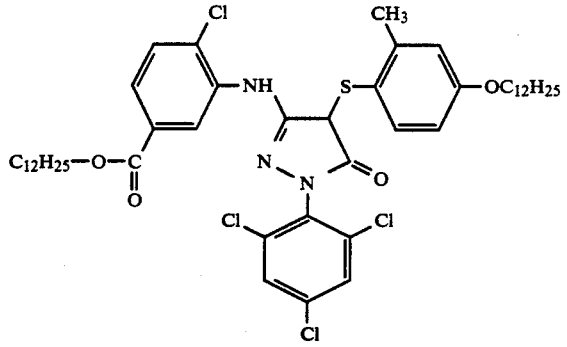
(M-28)
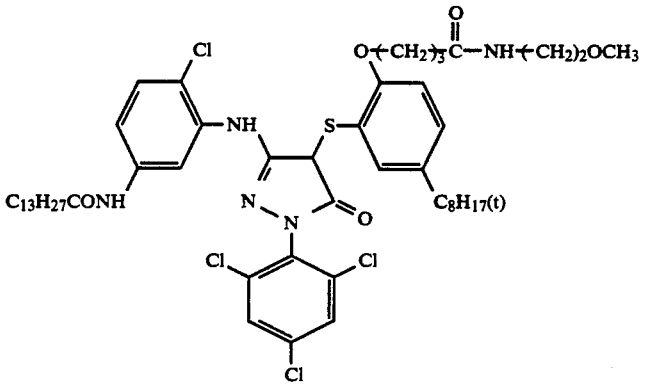

-continued
(M-29)
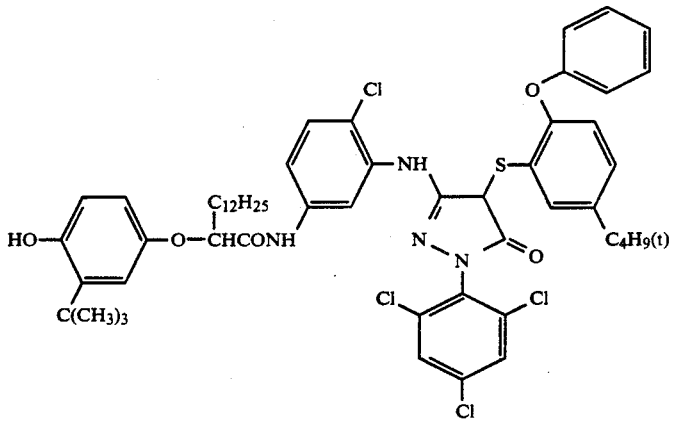
(M-30)
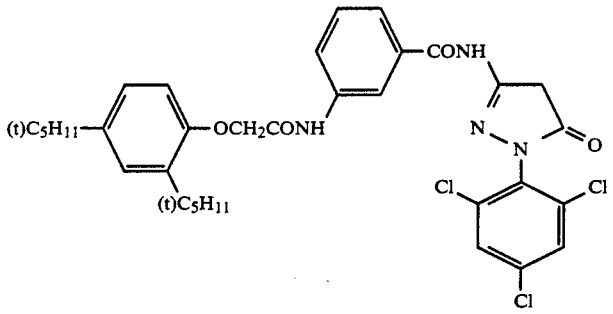
(M-31)
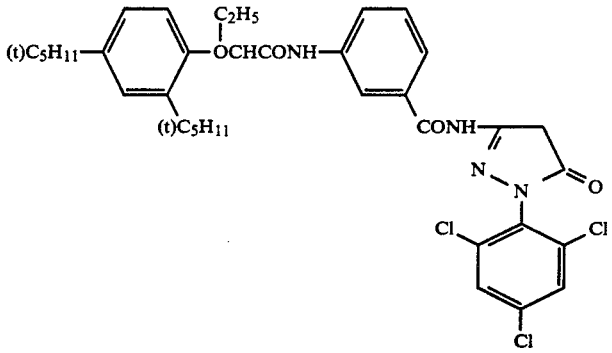
(M-32)
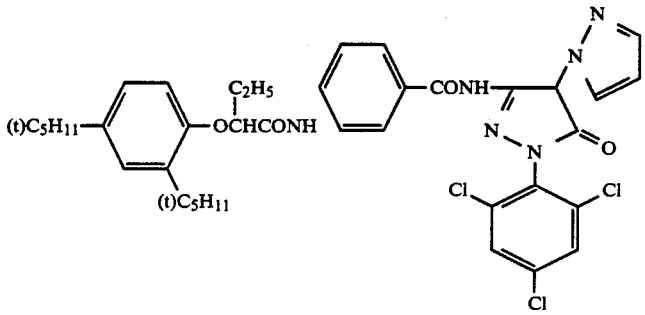

-continued
(M-33)
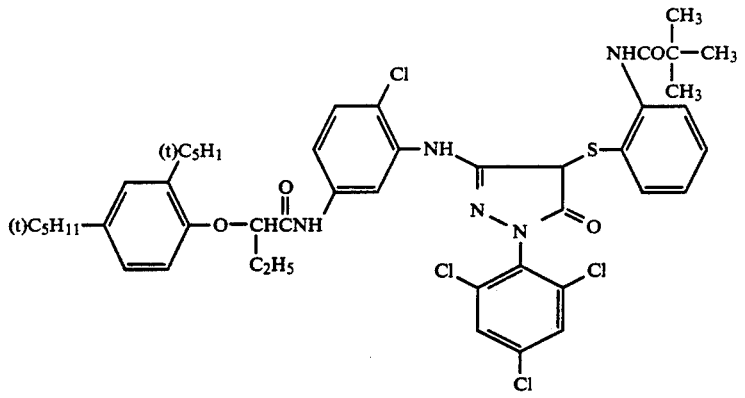
(M-34)
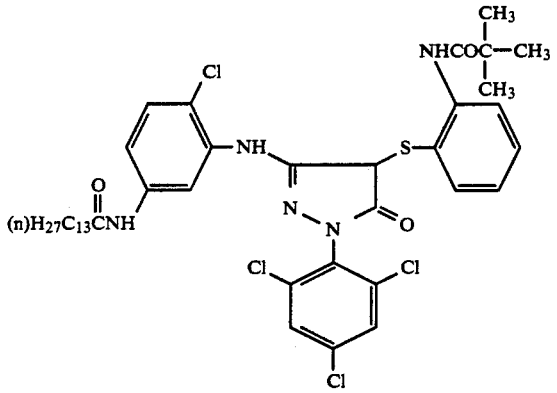
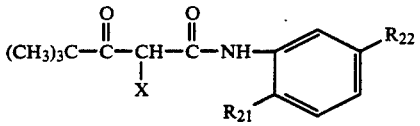
| Compound | $R_{22}$ | X | $R_{21}$ |
|---|---|---|---|
| Y-1 | $-COOCH(CH_3)COOC_{12}H_{25}$ | 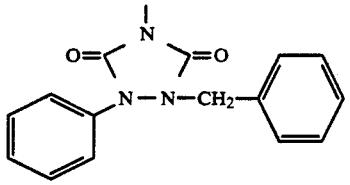 | Cl |
| Y-2 | $-COOCH(C_4H_9)COOC_{12}H_{25}$ | The same as the above | Cl |
| Y-3 | 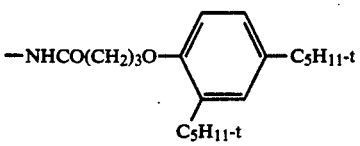 | 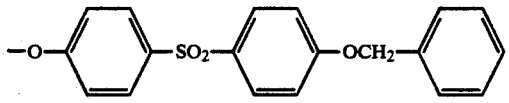 | Cl |
| Y-4 | The same as the above | 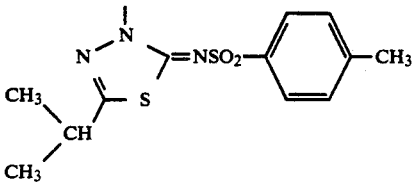 | Cl |

-continued
| | | | |
|---|---|---|---|
| Y-5 | 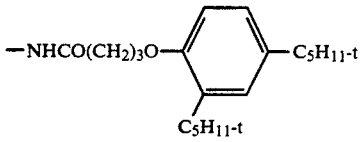 | 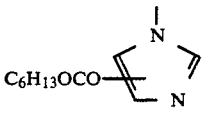 | Cl |
| Y-6 | $-NHSO_2C_{12}H_{25}$ | 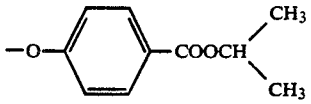 | Cl |
| Y-7 | $-NHSO_2C_{16}H_{33}$ | 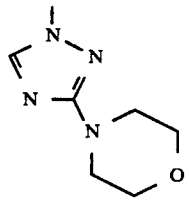 | Cl |
| Y-8 | $-COOC_{12}H_{25}(n)$ | 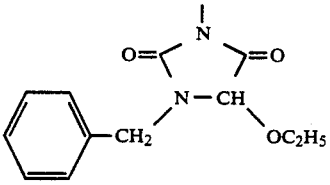 | Cl |
| Y-9 | 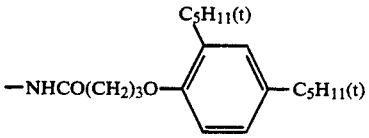 | 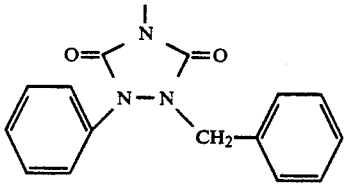 | Cl |
| Y-10 | 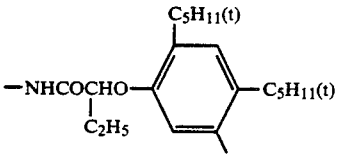 | 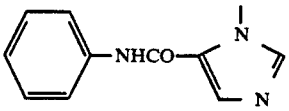 | $OCH_3$ |
| Y-11 | 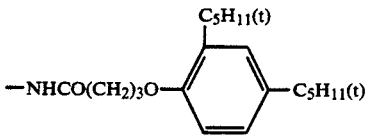 | 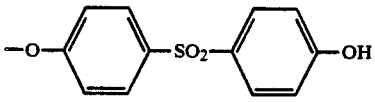 | Cl |
| Y-12 | 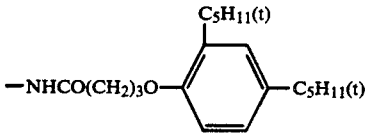 | 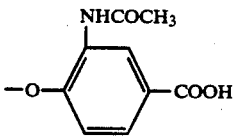 | Cl |
| Y-13 | 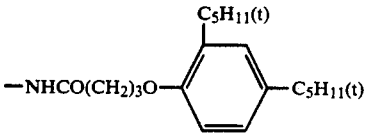 | 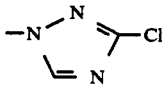 | Cl |

-continued
Y-14
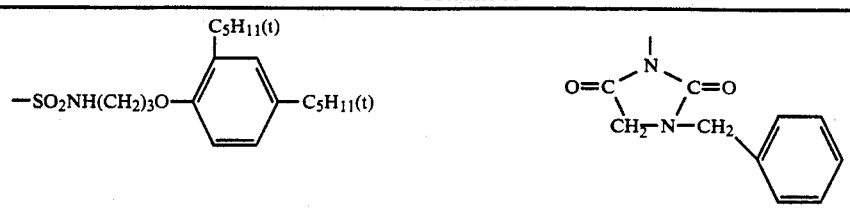
Cl
Y-15
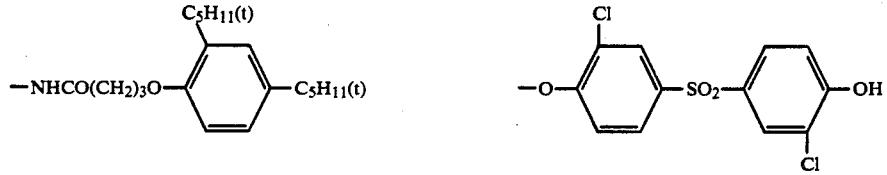
Cl
Y-16
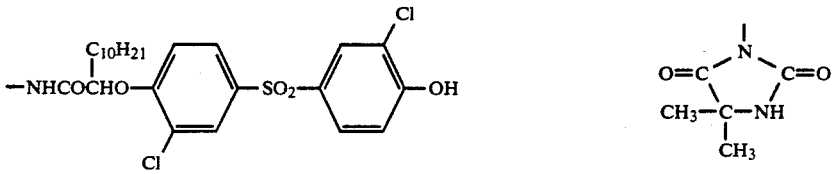
Cl
Y-17
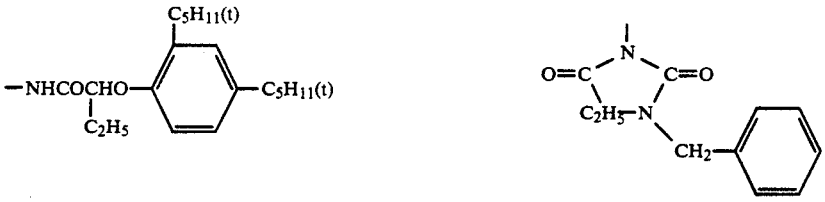
Cl
Y-18
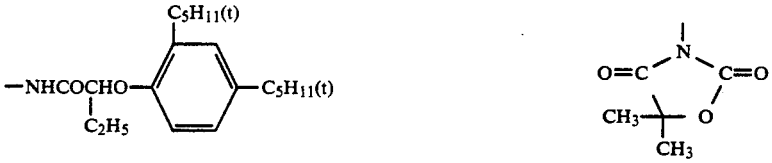
Cl
Y-19
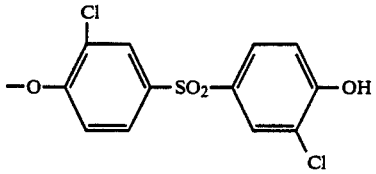
Cl
Y-20
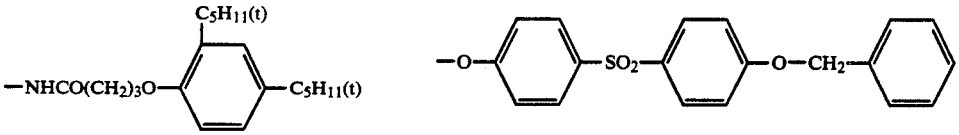
Cl
Y-21
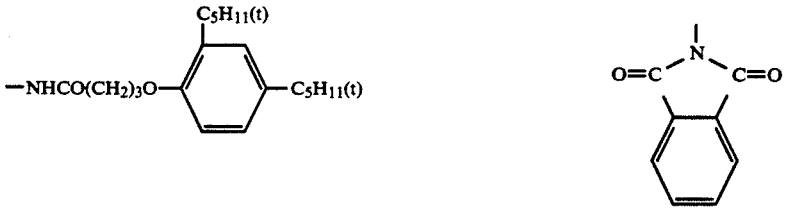
Cl
Y-22
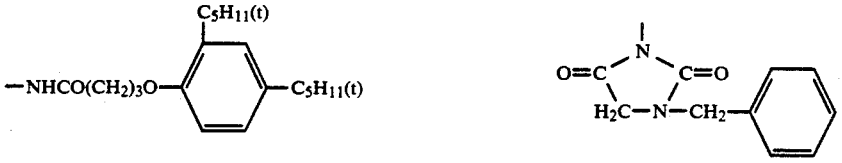
Cl -continued
| | | | |
|---|---|---|---|
| Y-23 | 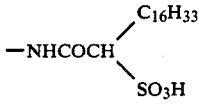 | 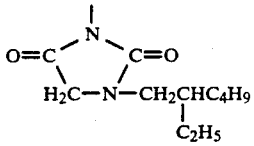 | Cl |
| Y-24 | 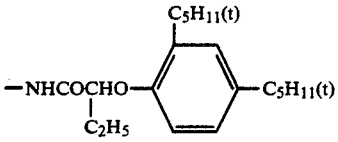 | 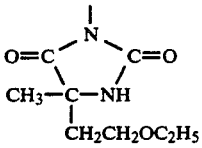 | Cl |
| Y-25 | 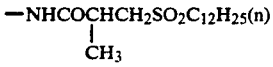 | 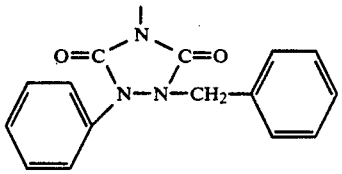 | Cl |
| Y-26 | $-NHSO_2C_{16}H_{33}(n)$ | 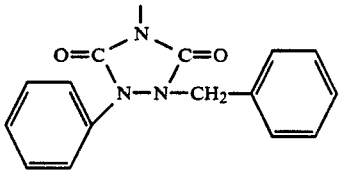 | Cl |
| Y-27 | 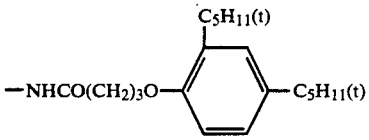 | 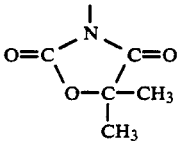 | Cl |
| Y-28 | The same as the above | 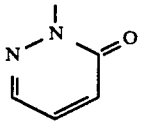 | Cl |
| Y-29 | The same as the above | 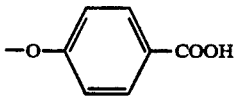 | Cl |
| Y-30 | $-NHSO_2-C_{16}H_{33}(n)$ | 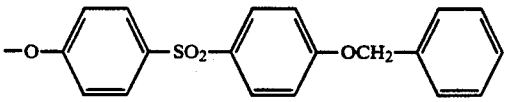 | Cl |
| Y-31 | The same as the above | 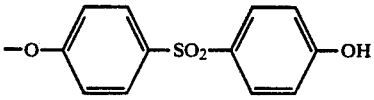 | Cl |
| Y-32 | $-SO_2-NHCH_3$ | 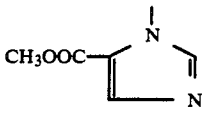 | $-OC_6H_{13}$ |

-continued

Y-33

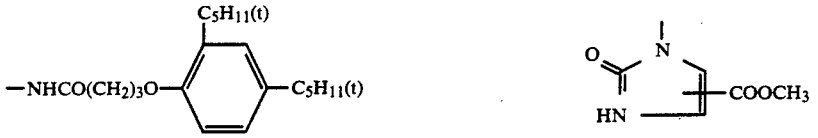

Y-34

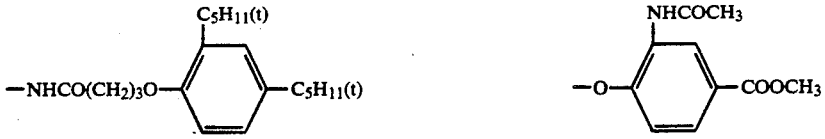

Y-35

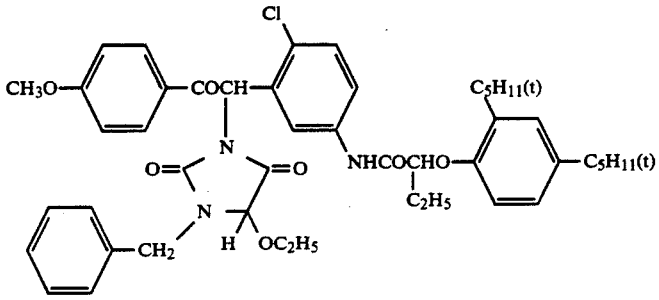

Y-36

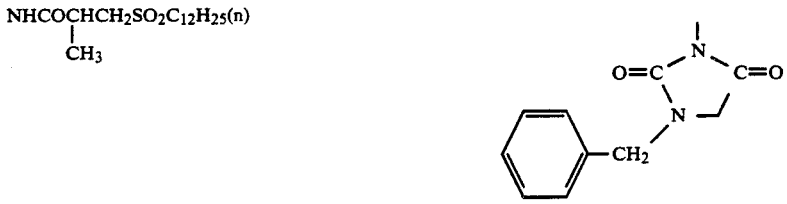

Y-37

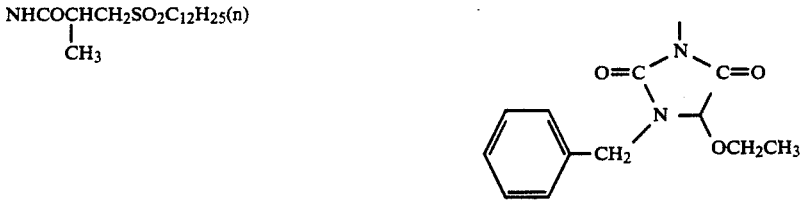

Y-38

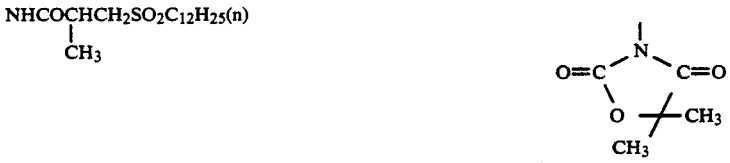

The color photographic material of the present invention has preferably, on the base, a blue-sensitive silver halide emulsion layer, a green-sensitive silver halide emulsion layer, and a red-sensitive silver halide emulsion layer, applied in the stated order or in any other order.

The silver halide to be used in the present invention comprises preferably silver chloride or silver chlorobromide wherein 90 mol% or over of all silver halides constituting the silver halide grains are silver chloride, and the composition is substantially free from silver iodide. Herein "substantially free from silver iodide" means that the silver iodide content is 1.0 mol% or below. A particularly preferable composition of the silver halide grains is silver chlorobromide wherein 95 mol% or more of all silver halides constituting the silver halide grains are silver chloride, and the composition is substantially free from silver iodide.

The silver halide grains according to the present invention have preferably localized phases having a silver bromide content of at least 10 mol% or over and less than 70 mol%. The arrangement of such localized phases high in silver bromide content is selected freely to meet the purpose and the phases may be present the surface or the near-surface of the grains, or may be divided inner grains and the surface or the near-surface of the grains. Further the localized phases may have a layered structure which surrounds the silver halide grain at inner grain or at the surface of the grain, or an uncontinuously isolated structure. One of specific examples of preferable arrangement of localized phases high in silver bromide content is such that a silver bromide content of at least 10 mol%, more preferably 20 mol% or more, are epitaxially grown on the surface (in particular, on the corners) of the silver halide grains.

Although the silver bromide content of such localized phases high in silver bromide content is preferably over 20 mol%, if the silver bromide content is too excessive, in some cases unfavorable properties will be brought into the photographic material; that is, for example, desensitization will be brought about when the photographic material undergoes pressure, or the sensitivity and gradation will change greatly because of a change in the composition of the processing solution. Taking these points into account, preferably the silver bromide content of localized phases is 20 to 60 mol%, with the most preference given to 30 to 50 mol%. Other silver halide composition than the localized phases high in silver bromide content is preferably of silver chloride. The silver bromide content of localized phases high in silver bromide content can be analized by the X-ray diffraction technique (described, for example, in *Kozokaiseki* in *Shin-Jikkenkaoaku Koza*, Vol. 6, edited by Nihon Kagaku-kai and published by Maruzen), or XPS--method (described, for example, in *Hyomen-bunseki* in *IMA, Oje electron Kodenshibunko no Oyo*, published by Kodansha). It is preferable that localized phases high in silver bromide content comprise 0.1 to 20 %, more preferably 0.5 to 7 %, of silver of all silver constituting silver halide grains of the present invention.

The interface between such localized phases high in silver bromide content and other phases may constitute a clear boundary or a short transition region where the halogen composition changes gradually. In order to confirm the position of silver bromide localized phases, method of observation by electron microscope or method described, for example, in European Patent Application (Publication) No. 273430A2 can be used.

In order to form such silver bromide localized phases, various techniques can be used. For instance, a soluble silver salt and a soluble halide can be reacted using the single-jet method or the double jet method. Further, localized phases can be formed by the so-called conversion method, which includes a step of converting an already formed silver halide into a silver halide whose solubility product is smaller. Alternatively, localized phases can be formed by adding finely divided silver bromide particles, thereby causing recrystallization on the surface of silver chloride grains to occur.

These methods are described, for example, in European Patent (Publication) No. 273430A2.

When the localized phases of the silver halide grains of the present invention or the substrates thereof are allowed to include metal ions other than silver ions (e.g., ions of metals of Group VIII of the Periodic Table, and ions of transition metal Group II of the Periodic Table, lead ions, and thallium ions), it is preferable because the effect of the present invention is more improved.

In the localized phases, for example, iridium ions, rhodium ions, and iron ions may be used mainly, and in the substrates, for example, combinations of ions of metals selected from the group consisting of osmium, iridium, rhodium, platinum, ruthenium, palladium, cobalt, nickel, and iron, or combinations of their complex ions may be used mainly. The type and the concentration of the ions in the localized phase may be different from those in the substrate.

To incorporate metals ions in localized phases and/or other grain parts (substrates) of silver halide grains, the metal ions may be added to the prepared solution before or during the formation of the grains, or during the physical ripening. For example, metal ions may be added to an aqueous gelatin solution, an aqueous halide solution, an aqueous silver salt solution, or other aqueous solution to form silver halide grains.

Alternatively, it is also possible that metal ions are previously contained in finely divided silver halide particles, then the mixture is added to a desired silver halide emulsion, and the finely divided silver halide particles are dissolved so that the metal ions may be introduced. This technique is effective particularly when metal ions are to be introduced to silver bromide localized phases present on the surfaces of silver halide grains. The way of adding metal ions may be suitably changed depending on which part of silver halide grains the metal ions should be present. Particularly, it is preferable that the localized phases are deposited together with at least 50 % of all iridium that is added at the time of the adjustment of the silver halide grains.

The expression "the localized phases are deposited together with iridium ions" means that an iridium compound is added simultaneously with, immediately before, or immediately after the supply of silver and/or halogen for the formation of the localized phases.

As silver halide grains involved in the present invention, ones including (100) planes or (111) planes, or ones including both of them, or even ones including higher planes, may be preferably used.

With respect to the shape of the silver halide grains to be used in the present invention, there are regular crystal shapes, such as a cubic shape, a tetradecahedral shape, and an octahedral shape, and irregular crystal shapes, such as a spherical shape and a tabular shape, and composite shapes of these. A mixture of grains having various crystal shapes can be used, and particularly it is desirable to use a mixture of grains wherein 50 % or over, preferably 70 % or over, and more preferably 90 % or over, are in the shape of a cube, tetradecahedron, or octahedron. The silver halide emulsion to be used in the present invention may be an emulsion wherein tabular grains having an aspect ratio (a length/thickness ratio) of 5 or over, and particularly preferably 8 or over, occupy 50 % or over of the total projected area of the grains.

Although it is good if the size of the silver halide grains used in the present invention is within the range that is generally used, preferably the average grain size of the silver halide grains used in the present invention is 0.1 to 1.5 μm. The grain diameter distribution may be a polydisperse or monodisperse distribution, with monodisperse distribution preferable. It is preferable that the grain size distribution showing the degree of the monodisperse distribution is such that the statistical deviation coefficient (the value s/d obtained by dividing the standard deviation s by the diameter d with the projected area approximated to a circle) is 20 % or below, and more preferably 15 % or below.

Two or more such tabular grain emulsions and monodisperse emulsions may be mixed. When emulsions are mixed, it is preferable that at least one of the emulsions has the above deviation coefficient, and more preferably the deviation coefficient of the mixed emulsion fills in the range of the above values.

A part other than the localized phase of the silver halide grains used in the present invention, that is, the so-called substrate part, may be such that the inside and the surface layer are different or uniform in phase.

The silver halide emulsion used in the present invention is generally one that has been physically ripened, chemically ripened, and spectrally sensitized.

With respect to chemical sensitizers used for chemical ripening, those described in JP-A No. 215272/1987, in the right lower column on page 18 to the right upper column on page 22, are preferably used, and with respect to spectral sensitizers, those described in JP-A No. 215272/1987, in the right upper column on page 22 to page 38, are preferably used.

With respect to antifoggants or stabilizers used during the production or storage of the silver halide emulsion used in the present invention, those described in JP-A No. 215272/1987, page 39 to page 72 (the right upper column), are preferably used.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used in combination with compounds represented by formula (II) and/or formula (III). That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 52225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. Nos. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent No. 2,027,731(A). To attain the purpose, these compounds can be added to the photosensitive layers by coemulsifying them with the corresponding couplers, with the amount of each compound being generally 5 to 100 wt% for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,352,681), benzophenone compounds (e.g., those described in JP-A No. 2784/1971), cinnamic acid ester compounds 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine a the second-order reaction-specific rate $k_2$ (in trioctyl phosphate at 80° C.) in the range of 1.0 l/mol·sec to $1\times10^{-5}$ l/mol·sec. The second-order reaction- specific rate can be determined by the method described in JP-A No. 158545/1983.

If $k_2$ is over this range, the compound itself becomes unstable, and in some cases the compound reacts with gelatin or water to decompose. On the other hand, if $k_2$ is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

Formula (FI)

$$R'_1-(A_1)n-X$$

Formula (FII)

$$R'_2-\underset{\underset{B_1}{|}}{C}=Y$$

wherein $R'_1$ and $R'_2$ each represent an aliphatic group, an aromatic group, or a heterocyclic group, n is 1 or 0, $A_1$ represents a group that will react with an aromatic amine developing agent to form a chemical bond therewith, X represents a group that will react with the aromatic amine developing agent and split off, $B_1$ represents a hydrogen atom, an aliphatic group, an aromatic group, a heterocyclic group, an acyl group, or a sulfonyl group, Y represents a group that will facilitate the addition of the aromatic amine developing agent to the compound represented by formula (FII), and $R'_1$ and X, or Y and $R'_2$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

$$R'_3—Z \qquad \text{Formula (GI)}$$

wherein $R'_3$ represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic $^nCH_3I$ value (R.G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987, 229145/1987, 230039/1989, and 57259/1989, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, an ultraviolet absorber. For example, benzotriazole compounds substituted by an aryl group (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), ester compounds of cinnamic acid (e.g., those described in U.S. Pat. Nos. 3,705,805 and 3,707,375), butadiene compounds (e.g., those described in U.S. Pat. No. 4,045,229), and benzooxydole compounds (e.g., those described in U.S. Pat. No. 3,700,455) are useful. Couplers capable of absorbing ultraviolet-radiation (e.g., α-naphthol series cyan dye-forming couplers) and polymers capable of absorbing ultraviolet-radiation may be also used. These ultraviolet absorbers may be mordanted in a specific layer.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 μm×6 μm, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or over. Therefore, the deviation coefficient $s/\overline{R}$ can be obtained by $$\sqrt{\frac{\sum_{i=1}^{n}(Ri-\overline{R})^2}{n-1}} \Big/ \frac{\sum_{i=1}^{n} Ri}{n}.$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

It is preferable that the present color photographic material is color-developed, bleach-fixed, and washed (or stabilized).

The color developer used in the present invention contains an aromatic primary amine color-developing agent. As the color-developing agent conventional ones can be used. Preferred examples of aromatic primary amine color-developing agents are p-phenylenediamine derivatives. Representative examples are given below, but they are not meant to limit the present invention:

D-1: N,N-diethyl-p-phenylenediamine
D-2: 2-amino-5-diethylaminotoluene
D-3: 2-amino-5-(N-ethyl-N-laurylamino)toluene
D-4: 4-[N-ethyl-N-(β-hydroxyethyl)amino]aniline
D-5: 2-methyl-4-[N-ethyl-N-(β-hydroxyethyl)amino]-aniline
D-6: 4-amino-3-methyl-N-ethyl-N-[β-(methanefonamido)ethyl]-aniline
D-7: N-(2-amino-5-diethylaminophenylethyl)-methanesulfonamide
D-8: N,N-dimethyl-p-phenylenediamine
D-9: 4-amino-3-methyl-N-ethyl-N-methoxyethylaniline
D-10: 4-amino-3-methyl-N-ethyl-N-β-ethoxyethylaniline
D-11: 4-amino-3-methyl-N-ethyl-N-β-butoxyethylaniline Of the above-mentioned p-phenylenediamine derivatives, 4-amino-3-methyl-N-ethyl-N-[β-(methane-sulfonamido)ethyl]-aniline (exemplified compound D-6) is particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 10 g, per liter of developer.

In practicing the present invention, it is preferable to use a developer substantially free from benzyl alcohol. Herein the term "substantially free from" means that the concentration of benzyl alcohol is preferably 2 ml/l or below, and more preferably 0.5 ml/l or below, and most preferably benzyl alcohol is not contained at all.

It is more preferable that the developer used in the present invention is substantially free from sulfite ions. Sulfite ions serve as a preservative of developing agents, and at the same time have an action for dissolving silver halides, and they react with the oxidized product of the developing agent, thereby exerting an action to lower the dye-forming efficiency. It is presumed that such actions are one of causes for an increase in the fluctuation of the photographic characteristics. Herein the term "substantially free from" sulfite ions means that preferably the concentration of sulfite ions is $3.0\times10^{-3}$ mol/l or below, and most preferably sulfite ions are not contained at all. However, in the present invention, a quite small amount of sulfite ions used for the prevention of oxidation of the processing kit in which the developing agent is condensed is not considered.

Preferably, the developer used in the present invention is substantially free from sulfite ions, and more preferably, in addition thereto it is substantially free from hydroxylamine. This is because hydroxylamine serves as a preservative of the developer, and at the same time has itself an activity for developing silver, and it is considered that the fluctuation of the concentration of hydroxylamine influences greatly the photographic characteristics. Herein the term "substantially free from hydroxylamine" means that preferably the concentration of hydroxylamine is $5.0\times10^{-3}$ mol/l or below, and most preferably hydroxylamine is not contained at all.

It is preferable that the developer used in the present invention contains an organic preservative instead of hydroxylamine or sulfite ions, in that process color-contamination and fluctuation of the photographic quality in continuous processing can be suppressed.

Herein the term "organic preservative" refers to organic compounds that generally, when added to the processing solution for the color photographic material, reduce the speed of deterioration of the aromatic primary amine color-developing agent. That is, organic preservatives include organic compounds having a function to prevent the color-developing agent from being oxidized, for example, with air, and in particular, hydroxylamine derivatives (excluding hydroxylamine, hereinafter the same being applied), hydroxamic acids, hydrazines, hydrazides, phenols, α-hydroxyketones, α-aminoketones, saccharides, monoamines, diamines, polyamines, quaternary amines, nitroxyradicals, alcohols, oximes, diamide compounds, and condensed cyclic amines are effective organic preservatives. These are disclosed, for example, in JP-A Nos. 4235/1988, 30845/1988, 21647/1988, 44655/1988, 355/1988, 43140/1988, 56654/1988, 58346/1988, 43138/1988, 46041/1988, 170642/1988, 44657/1988, and 44656/1988, U.S. Pat. Nos. 3,615,503 and 2,494,903, JP-A No. 143020/1977, and JP-B 30496/1973.

As the other preservative, various metals described, for example, in JP-A Nos. 44148/1982 and 53749/1982, salicylic acids described, for example, in JP-A No. 180588/1984, alkanolamines described, for example, in JP-A No. 3532/1979, polyethyleneimines described, for example, in JP-A No. 94349/1981, aromatic polyhydroxyl compounds described, for example, in U.S. Pat. No. 3,746,544 may be included, if needed. It is particularly preferable the addition of alkanolamines such as triethanolamine, dialkylhydroxylamines such as diethylhydroxylamine, hydrazine derivatives, or aromatic polyhydroxyl compounds.

Of the above organic preservatives, hydroxylamine derivatives and hydrazine derivatives (i.e., hydrazines and hydrazides) are preferable and the details are described, for example, in Japanese Patent Application Nos. 255270/1987, 9713/1988, 9714/1988, and 11300/1988.

The use of amines in combination with the above-mentioned hydroxylamine derivatives or hydrazine derivatives is preferable in view of stability improvement of the color developer resulting its stability improvement during the continuous processing.

As the example of the above-mentioned amines cyclic amines described, for example, in JP-A No. 239447/1988, amines described, for example, in JP-A No. 128340/1988, and amines described, for example, in Japanese Patent Application Nos. 9713/1988 and 11300/1988.

In the present invention, it is preferable that the color developer contains chloride ions in an amount of $3.5\times10^{-2}$ to $1.5\times10^{-1}$ mol/l, more preferably $4\times10^{-2}$ to $1\times10^{-1}$ mol/l. If the concentration of ions exceeds $1.5\times10^{-1}$ mol/l, it is not preferable that the development is made disadvantageously slow, not leading to attainment of the objects of the present invention such as rapid processing and high density. On the other hand, if the concentration of chloride ions is less than $3.5\times10^{-2}$ mol/l, fogging is not prevented.

In the present invention, the color developer contains bromide ions preferably in an amount of $3.0\times10^{-5}$ to $1.0\times10^{-3}$ mol/l. More preferably bromide ions are contained in an amount $5.0\times10^{-5}$ to $5.0\times10^{-4}$ mol/l, most preferably $1.0\times10^{-4}$ to $3.0\times10^{-4}$ mol/l. If the concentration of bromide ions is more than $1.0\times10^{-3}$ mol/l, the development is made slow, the maximum density and the sensitivity are made low, and if the concentration of bromide ions is less than $3.0\times10^{-5}$ mol/l, fogging is not prevented sufficiently.

Herein, chloride ions and bromide ions may be added directly to the developer, or they may be allowed to dissolve out from the photographic material in the developer.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Chloride ions and bromide ions may be supplied from a brightening agent.

As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

Preferably the color developer used in the present invention has a pH of 9 to 12, and more preferably 9 to 11.0, and it can contain other known developer components.

In order to keep the above pH, it is preferable to use various buffers. As buffers, use can be made, for example, of phosphates, carbonates, borates, tetraborates, hydroxybenzoates, glycyl salts, N,N-dimethylglycinates, leucinates, norleucinates, guanine salts, 3,4-dihydroxyphenylalanine salts, alanine salts, aminolbutyrates, 2-amino-2-methyl-1,3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering function in the high pH range of a pH of 9.0 or higher, they do not adversely affect the photographic function (for example, to cause fogging), and they are inexpensive. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The amount of buffer to be added to the color developer is preferably 0.1 mol/l, and particularly preferably 0.1 to 0.4 mol/l.

In addition to the color developer can be added various chelating agents to prevent calcium or magnesium from precipitating or to improve the stability of the color developer. As the example of chelating agents can be mentioned nitrilotriacetic acid, diethylenediaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, glycol ether diaminetetraacetic acid, ethylenediamine-ortho-hyroxyphenyltetraacetic acid, hydroxyethylidene-1,1-diphosphonic acid, and N,N'-bis(2-hydroxybenzyl)ethylenediamine-N,N'-diacetic acid.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine, and adenine.

It is preferable that the color developer used in the present invention contains a brightening agent. As a brightening agent, 4,4'-diamino-2,2'-disulfostilbene compounds are preferable. The amount of brightening agent to be added is 0 to 5 g/l, and preferably 0.1 to 4 g/l.

If necessary, various surface-active agents may be added, such as alkyl sulfonates, aryl sulfonates, aliphatic acids, and aromatic carboxylic acids.

The processing temperature of the color developer of the invention may be 20° to 50° C., and preferably 30 to 40° C. The processing time may be 20 sec to 5 min, and preferably 30 sec to 2 min. Although it is preferable that the replenishing amount is as small as possible, it is suitable that the replenishing amount is 20 to 600 ml, preferably 50 to 300 ml, more preferably 60 to 200 ml, and most preferably 60 to 150 ml, per square meter of the photographic material.

Next, the bleach fixing solution that are acceptable in the present invention will be described.

As the bleaching agent used in the bleaching solution or the bleach-fixing solution used in present invention, use is made of any bleaching agents, but particularly it is preferable to use organic complex salts of iron(III) (e.g., complex salts of aminopolycarboxylic acids, such as ethylenediaminetetraacetic acid, and diethylenetriaminepentaacetic acid, aminopolyphosphonic acids, phosphonocarboxylic acids, and organic phosphonic acids); organic acids, such as citric acid, tartaric acid, and malic acid; persulfates; and hydrogen peroxide.

Of these, organic complex salts of iron(III) are particularly preferable in view of the rapid processing and the prevention of environmental pollution. Aminopolycarboxylic acids, aminopolyphosphonic acids, or organic phosphonic acids, and their salts useful to form organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid. These compounds may be in the form of any salts of sodium, potassium, lithium, or ammonium. Of these compounds, iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferable, because they are high in bleaching power. These ferric ion, complex salts may be used in the form of a complex salt, or they may be formed in solution by using a ferric salt such as ferric sulfate, ferric chloride, ferric nitrate, ammonium ferric sulfate, and ferric phosphate, and a chelating agent such as aminopolycarboxylic acids, aminopolyphosphonic acids, and phosphonocarboxylic acids. The chelating agent may be used in excess to form the ferric ion complex salt. Of iron complexes, aminopolycarboxylic acid iron complexes are preferable, and the amount thereof to be added is 0.01 to 1.0 mol/l, and more preferably 0.05 to 0.50 mol/l.

In the bleach-fixing solution and/or the bath preceding them, various compounds may be used as a bleach accelerating agent. For example, the following compounds are used: compounds having a mercapto group or a disulfido bond, described in U.S. Pat. No. 3,893,858, German Patent No. 1,290,812, JP-A No. 95630/1978, and *Research Disclosure* No. 17129 (July 1978), thiourea compounds described, for example, in JP-B No. 8506/1970, JP-A Nos. 0832/1977 and 32735/1978, and U.S. Pat. No. 3,706,561, or halides such as iodides and bromides, which are preferable because of their excellent bleaching power.

Further, the bleach-fixing solution used in the present invention can contain rehalogenizing agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contained, for example, one or more inorganic acids and organic acids or their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8-octanedithiol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol. The pH range of the bleach-fixing solution is preferably 3 to 6.3, and particularly preferably 5.5 or below.

Further, the bleach-fixing solution may additionally contain various brightening agents, antifoaming agents, surface-active agents, polyvinyl pyrrolidone, and organic solvents, such as methanol.

The bleach-fixing solution contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.05 mol/l, and more preferably 0.04 to 0.40 mol/l, in terms of sulfite ions.

As a preservative, generally a bisulfite is added, but other compounds, such as ascorbic acid, carbonyl bisulfite addition compound, or carbonyl compounds, may be added.

If required, for example, buffers, brightening agents, chelating agents, anti-foaming agents, and mildew-proofing agents may be added.

The silver halide color photographic material used in the present invention is generally washed and/or stabilized after the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television Engineers*, Vol. 64, pp. 248 to 253 (May 1955). Generally, the number of stages in a multi-stage countercurrent system is preferably 2 to 6, and particularly preferably 2 to 4.

According to the multi-stage countercurrent system, the amount of washing water can be reduced considerably. For example, the amount can be 0.5 to 1 per square meter of the photographic material, and the effect of the present invention is remarkable. But a problem arises that bacteria can propagate due to the increase in the dwelling time of the water in the tanks, and the suspended matter produced will adhere to the photographic material. To solve such a problem in processing the color photographic material of the present invention, the process for reducing calcium and magnesium described in JP-A No. 131632/1986 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Horiguchi in *Bokin Bobai-zai no Kaqaku*, (1986) published by Sankyo-Shuppan, *Biseibutsu no Mekkin, Sakkin, Bobaigijutsu* (1982) edited by Eiseigijutsu-kai), published by Kogyo-Gijutsu-kai, and *Bokin Bobai-zai Jiten* (1986) edited by Nihon Bokin Bobai-gakkai), can be used.

Further, the washing water can contain surface-active agents as a water draining agent, and chelating agents such as EDTA as a water softener.

After the washing step mentioned above, or without the washing step, the photographic material is processed with a stabilizer. The stabilizer can contain compounds that have an image-stabilizing function, such as aldehyde compounds, for example typically formalin, buffers for adjusting the pH of the stabilizer suitable to the film pH for the stabilization of the dye, and ammonium compounds. Further, in the stabilizer, use can be made of the above-mentioned bactericides and anti-mildew agent for preventing bacteria from propagating in the stabilizer, or for providing the processed photographic material with mildew-proof properties.

Still further, surface-active agents, brightening agents, and hardening agents can also be added. In the processing of the photographic material of the present invention, if the stabilization is carried out directly without a washing step, known methods described, for example, in JP-A Nos. 8543/1982, 14834/1983, and 220345/1985, can be used.

Further, chelating agents, such as 1-hydroxyethylidene-1,1-diphosphonic acid, and ethylenediaminetetramethylenephosphonic acid, and magnesium and bismuth compounds can also be used in preferable modes.

A so-called rinse can also be used as a washing solution or a stabilizing solution, used after the desilverization.

The pH of the washing step or a stabilizing step is preferably 4 to 10, more preferably 5 to 8. The temperature will vary depending, for example, on the application and the characteristics of the photographic material, and it generally will be 15° to 45° C., and preferably 20° to 40° C. Although the time can be arbitrarily set, it is desirable that the time is as short as possible, because the processing time can be reduced. Preferably the time is 15 sec to 1 min and 45 sec, and more preferably 30 sec to 1 min and 30 sec. It is preferable that the replenishing amount is as low as possible in view, for example, of the running cost, the reduction in the discharge, and the handleability.

When the color photographic material of the present invention is processed rapidly, a color photograph can be obtained wherein the color-forming properties are high, blix discoloration of the produced dye image is well suppressed, so that after the processing the color balance of the image may not become disturbed, and the image quality is excellent.

Next, the present invention will be described in detail in accordance with examples, but the invention is not limited to these Examples.

EXAMPLE 1

A multilayer photographic material (101) was prepared by multi-coatings composed of the following layer composition on a two-side polyethylene laminated paper support. Coating solutions were prepared as follows:

Preparation of the First Layer Coating Solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-1) were added and dissolved. The resulting solution was dispersed and emulsified in 185 ml of 10 % aqueous gelatin solution containing 8 ml of sodium dodecylbenzenesulfonate. Separately another emulsion was prepared by adding two kinds of blue-sensitive sensitizing dye, shown below, to a blend of silver chlorobromide emulsions (cubic grains, 3:7 (silver mol ratio) blend of grains having 0.88 μm and 0.7 μm of average grain size, and 0.08 and 0.10 of deviation coefficient of grain size distribution, respectively, each in which 0.2 mol% of silver bromide was located at the surface of grains) in such amounts that each dye corresponds $2.0\times10^{-4}$ mol to the large size emulsion and $2.5\times10^{-4}$ mol to the small size emulsion, per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first-layer coating solution. As a gelatin hardener for the respective layers, 1-hydroxy-3,5-dichloro-s-treazine sodium salt was used.

As spectral-sensitizing dyes for the respective layers, the following compounds were used:

Blue-sensitive emulsion layer

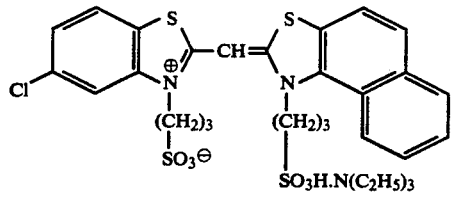

and

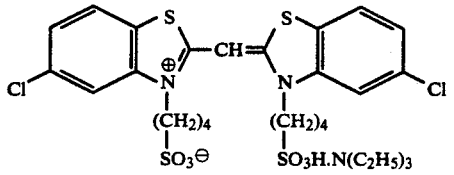

(each $2.0\times10^{-4}$ mol to the large size emulsion and $2.5\times10^{-4}$ mol to the small size emulsion, per mol of silver halide.)

Green-sensitive emulsion layer

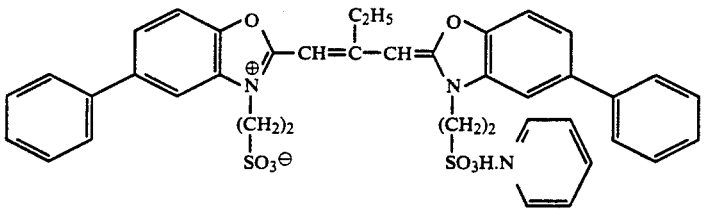

($4.0\times10^{-4}$ mol to the large size emulsion and $5.6\times10^{-4}$ mol to the small size emulsion, per mol of silver halide) and

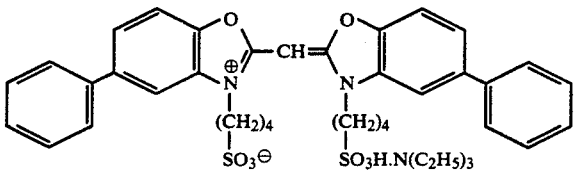

($7.0\times10^{-5}$ mol to the large size emulsion and $1.0\times10^{-5}$ mol to the small size emulsion, per mol of silver halide)

Red-sensitive emulsion layer

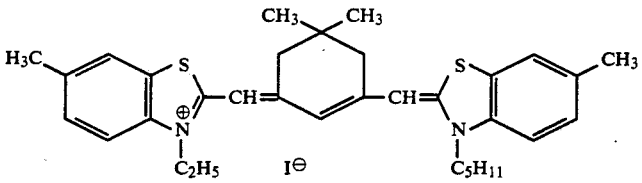

($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

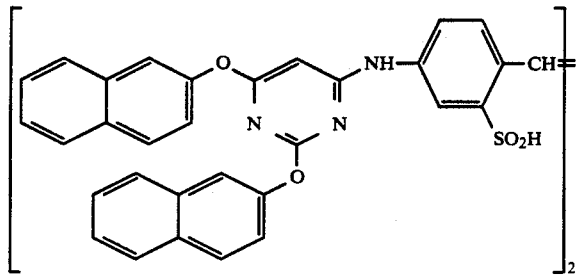

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

The dyes shown below were added to the emulsion layers for prevention of irradiation.

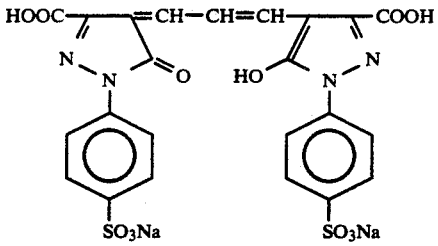

and

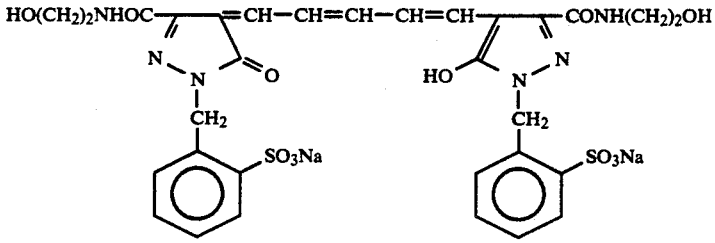

Composition of Layers

The composition of each layer is shown below. The figures represent coating amount (g/m²). The coating amount of each silver halide emulsion is given in terms of silver.

Supporting Base

Paper laminated on both sides with polyethylene (a white pigment, $TiO_2$, and a bluish dye, ultramarine, were included in the first layer side of the polyethylene-laminated film)

| | |
|---|---|
| First Layer (Blue-sensitive emulsion layer): | |
| The above-described silver chlorobromide emulsion | 0.30 |
| Gelatin | 1.86 |
| Yellow coupler (ExY) | 1.04 |
| Image-dye stabilizer (Cpd-1) | 0.19 |
| Solvent (Solv-1) | 0.35 |
| Image-dye stabilizer (Cpd-7) | 0.06 |
| Second Layer (Color-mix preventing layer): | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsions (cubic grains, 1:3 (Ag mol ratio) blend of grains having 0.55 μm and 0.39 μm of average grain size, and 0.10 and 0.08 of deviation coefficient of grain size distribution, respectively, each in which 0.8 mol % of AgBr was located at the surface of grains) | 0.12 |
| Gelatin | 1.24 |
| Magenta coupler (ExM) | 0.18 |
| Image-dye stabilizer (Cpd-2) | 0.03 |

-continued

| | |
|---|---|
| Image-dye stabilizer (Cpd-3) | 0.15 |
| Image-dye stabilizer (Cpd-4) | 0.02 |
| Image-dye stabilizer (Cpd-9) | 0.02 |
| Solvent (Solv-2) | 0.45 |
| Fourth Layer (Ultraviolet absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chlorobromide emulsions (cubic grains, 1:4 (Ag mol ratio) blend of grains having 0.58 μm and 0.45 μm of average grain size, and 0.09 and 0.11 of deviation coefficient of grain size distribution, respectively, each in which 0.6 mol % of AgBr was located at the surface of grains) | 0.23 |
| Gelatin | 1.34 |
| Cyan coupler (Compound A) | 0.32 |
| Image-dye stabilizer (Cpd-6) | 0.17 |
| Solvent (Compound a) | 0.15 |
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler

Mixture (1:1 in molar ratio) of

R =

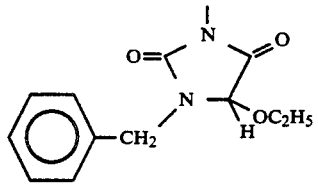

and R =

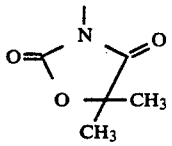

of the following formula

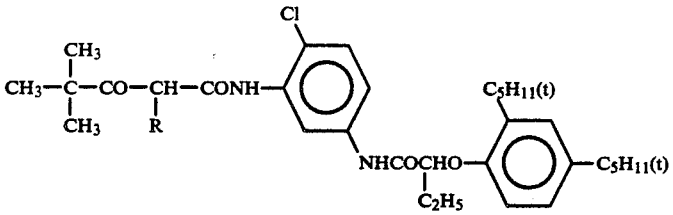

(ExM) Magenta coupler

Mixture (1:1 in molar ratio) of

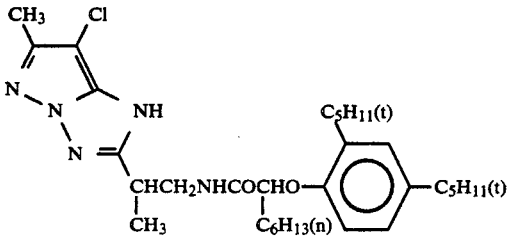

and

-continued
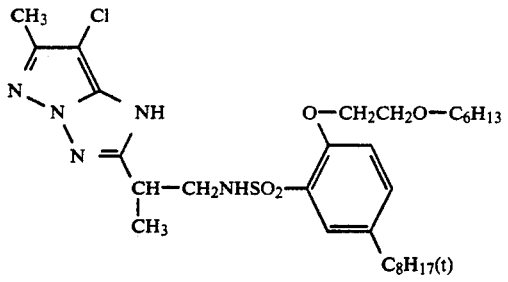
(Cpd-1) Image-dye stabilizer
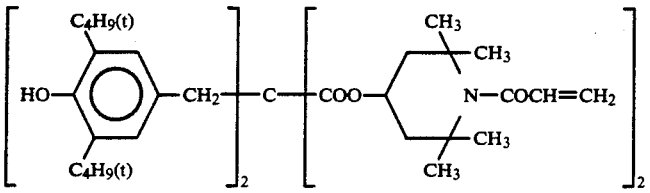
(Cpd-2) Image-dye stabilizer
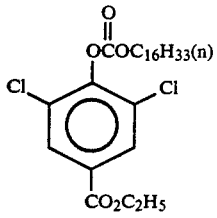
(Cpd-3) Image-dye stabilizer
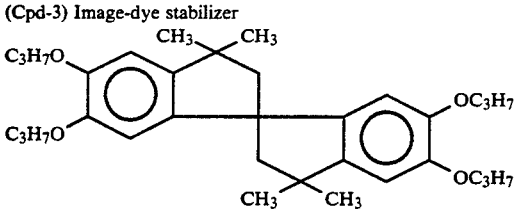
(Cpd-4) Image-dye stabilizer
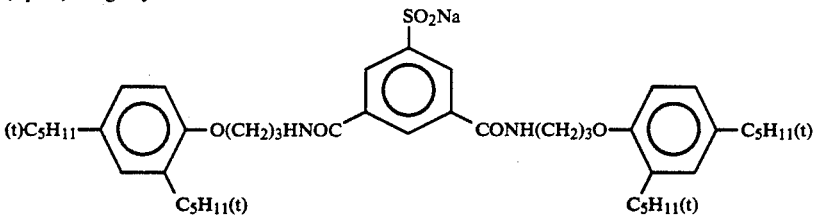
(Cpd-5) Color-mix inhibitor
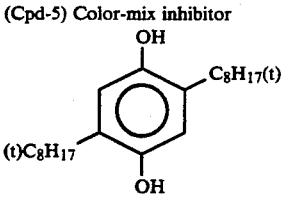
(Cpd-6) Image-dye stabilizer
Mixture (2:4:4 in weight ratio) of
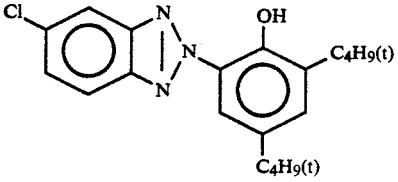

-continued
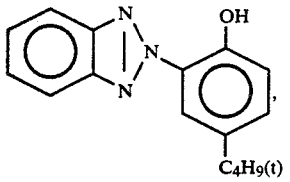
and
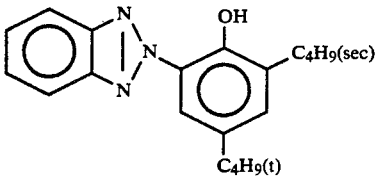
(Cpd-7) Image-dye stabilizer
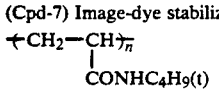
Average molecular weight: 60,000
(Cpd-8) Image-dye stabilizer
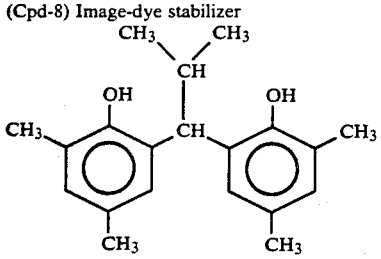
(UV-1) Ultraviolet ray absorber
Mixture (4:2:4 in weight ratio) of
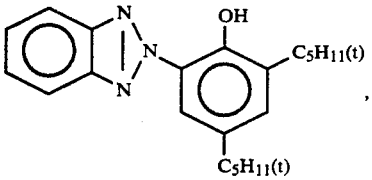
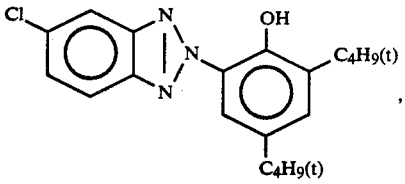
and
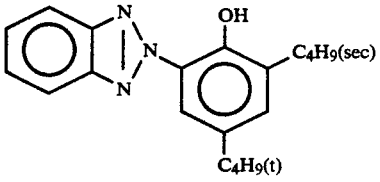
(Solv-1) Solvent
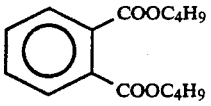
(Solv-2) Solvent
Mixture (2:1 in volume ratio) of -continued
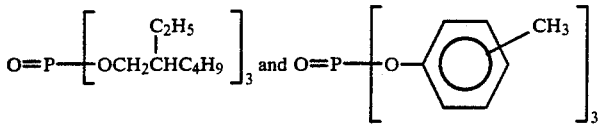
(Solv-4) Solvent
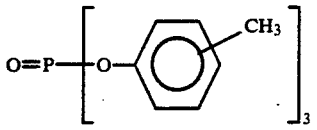
(Solv-5) Solvent (Solv-6) Solvent
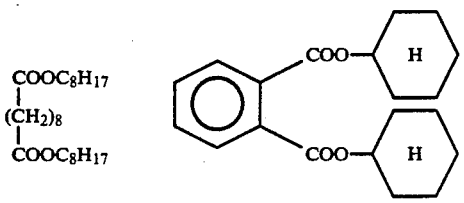
Cyan coupler
Compound A
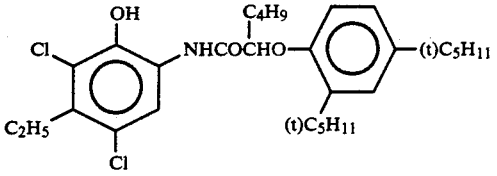
Compound B
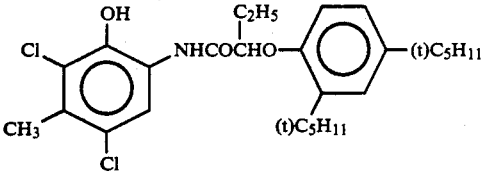
Compound C
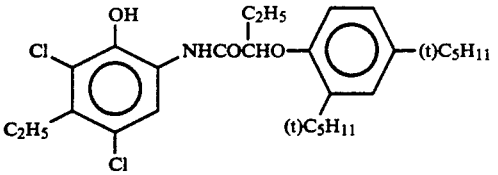
Compound D
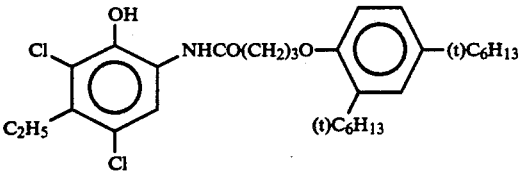
Compound E
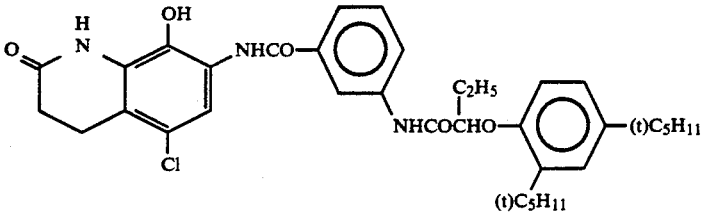

-continued

High-boiling organic solvent:
Compound a

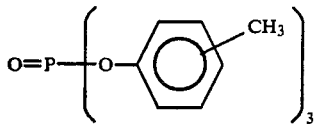

Viscosity: 57.6 cp

Compound b

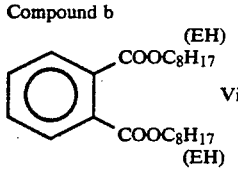

Viscosity: 62.7 cp

Compound c

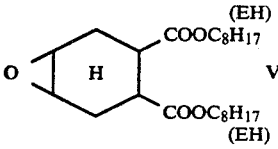

Viscosity: 80 cp

Compound d
$O{=}P{\leftarrow}O{-}C_9H_{19}(iso))_3$ Viscosity: 36.3 cp

Note:
$-C_8H_{17}^{(EH)} = -CH_2CH(C_2H_5)C_4H_9$

Then, photographic materials (102 to 132) were prepared in the same way as for photographic material (101), except that, as shown in Table 1, in the seventh layer, which was a red-sensitive layer, the cyan coupler, the high-boiling organic solvent, the compound of formula (II) or (III), the organic polymer compound, and the particle size of the emulsified dispersion were changed. The average particle diameter of the emulsified dispersion was measured by Nanosizer (made by Coulter Co. England) (a particle-diameter-measuring apparatus that uses laser beam scattering).

After image-wise exposure of the above Photographic Materials, they were continuously processed (running test) by using a paper processor in the following processing steps until the replenishing amount reached a point twice the amount of the tank volume for color development.

| Processing steps | Temperature | Time | Replenisher Amount* | Tank Volume |
|---|---|---|---|---|
| Color Developing | 35° C. | 45 sec. | 161 mλ | 17 λ |
| Bleach-fixing | 30–35° C. | 45 sec. | 215 mλ | 17 λ |
| Rinsing 1 | 30–35° C. | 20 sec. | — | 10 λ |
| Rinsing 2 | 30–35° C. | 20 sec. | — | 10 λ |
| Rinsing 3 | 30–35° C. | 20 sec. | 50 mλ | 10 λ |
| Drying | 70–80° C. | 60 sec. | | |

Note: *Replenisher amount is shown in mλ per $m^2$ of photographic material. Rinsing steps were carried out in 3-tanks counter-flow mode from the tank of rinsing 3 towards the tank of rinsing 1. The opened surface ratio was changed by changing the size of floating lid.

The compositions of each processing solution were as follows:

Color developer

| | Tank Solution | Replenisher |
|---|---|---|
| Water | 800 mλ | 800 mλ |
| Ethylenediamine-N,N,N',N'-tetramethylenephosphonic acid | 1.5 g | 1.5 g |
| Potassium bromide | 0.015 g | |
| Triethanolamine | 8.0 g | 12.0 g |
| Sodium chloride | 1.4 g | |
| Potassium carbonate | 25 g | 25 g |
| N-ethyl-N-(β-methanesulfonamidoethyl)-3-methyl-4-aminoaniline sulfonate | 5.0 g | 7.0 g |
| N,N-bis(carboxymethyl)hydrazine | 5.5 g | 7.0 g |
| Fluorescent brightening agent (WHITEX-4, made by Sumitomo Chemical Ind. Co.) | 1.0 g | 2.0 g |
| Water to make | 1000 mλ | 1000 mλ |
| pH (25° C.) | 10.05 | 10.45 |

Bleach-fixing solution

| (Both tank solution and replenisher) | |
|---|---|
| Water | 400 mλ |
| Ammonium thiosulfate (56 wt %) | 100 mλ |
| Sodium sulfite | 17 g |
| Iron (III) ammonium ethylenediaminetetraacetate dihydrate | 55 g |
| Disodium ethylenediaminetetraacetate | 5 g |
| Ammonium bromide | 40 g |
| Water to make | 1000 mλ |
| pH (25° C.) | 5.0 |

Rinsing solution

Both tank solution and replenisher

Ion-exchanged water (Calcium and magnesium each are contained in an amount of 3 ppm or below)

The cyan reflection density of the Dmax part of each of the processed photographic print papers was measured, then the photographic print paper was dipped in CN-16N2, manufactured by Fuji Photo Film Co., Ltd., at 30° C. for 4 min, to get the leuco compound of cyan back to the dye, and the measurement was carried out again. The densities immediately after the processing and after the restoring the dye from the leuco compound are shown in Table 1. The degrees of restoration (prevention of forming a leuco compound of cyan dyes) are given as color-formed rates in Table 1.

$$\text{Color formed rate} = \frac{\text{cyan density before reprocessing}}{\text{cyan density after reprocessing}} \times 100$$

TABLE 1

| Photographic Material No. | Coupler | High-boiling Organic Solvent | Compound of Formula (II) or (III) | Grain Diameter of Emulsified Dispersion (μm) | Max. Density (Dmax) Before Reprocessing | Max. Density (Dmax) After Reprocessing | Color-forming Rate | Remarks |
|---|---|---|---|---|---|---|---|---|
| 101 | Compound A | Compound a | — | 0.15 | 1.58 | 2.44 | 65% | Comparative Example |
| 102 | Compound A | Compound a | III-13 | 0.14 | 1.69 | 2.41 | 70% | Comparative Example |
| 103 | Compound A | S-5 | III-13 | 0.15 | 1.85 | 2.43 | 76% | Comparative Example |
| 104 | Compound A | S-5 | III-13 | 0.24 | 1.89 | 1.98 | 95% | Comparative Example |
| 105 | Compound B | Compound b | — | 0.14 | 1.55 | 2.50 | 62% | Comparative Example |
| 106 | Compound B | Compound b | II-2 | 0.25 | 1.50 | 1.93 | 77% | Comparative Example |
| 107 | Compound B | Compound c | II-2 | 0.28 | 1.51 | 1.94 | 78% | Comparative Example |
| 108 | Compound B | S-1 | II-2 | 0.29 | 1.79 | 1.90 | 94% | Comparative Example |
| 109 | Compound C | S-5 | III-13 | 0.26 | 1.78 | 1.89 | 94% | Comparative Example |
| 110 | Compound D | S-1 | III-12 | 0.28 | 1.74 | 1.90 | 92% | Comparative Example |
| 111 | Compound E | S-9 | II-2 | 0.24 | 1.81 | 1.92 | 94% | Comparative Example |
| 112 | I-3 | Compound a | — | 0.15 | 1.38 | 2.51 | 56% | Comparative Example |
| 113 | I-3 | Compound a | III-13 | 0.16 | 1.68 | 2.52 | 67% | Comparative Example |
| 114 | I-3 | S-5 | III-13 | 0.16 | 2.01 | 2.52 | 80% | Comparative Example |
| 115 | I-3 | S-5 | III-13 | 0.20 | 2.39 | 2.51 | 95% | This Invention |
| 116 | I-3 | S-5 | III-12 | 0.26 | 2.42 | 2.50 | 97% | This Invention |
| 117 | I-3 | S-1 | II-2 | 0.24 | 2.40 | 2.45 | 98% | This Invention |
| 118 | I-3 | S-2 | III-2 | 0.13 | 2.03 | 2.51 | 81% | Comparative Example |
| 119 | I-3 | S-7 | III-14 | 0.28 | 2.43 | 2.50 | 97% | This Invention |
| 120 | I-3 | S-9 | II-10 | 0.20 | 2.40 | 2.48 | 97% | This Invention |
| 121 | I-4 | Compound b | — | 0.15 | 1.60 | 2.53 | 63% | Comparative Example |
| 122 | I-4 | Compound b | II-2 | 0.16 | 1.79 | 2.52 | 71% | Comparative Example |
| 123 | I-4 | Compound d | II-2 | 0.29 | 2.07 | 2.53 | 82% | Comparative Example |
| 124 | I-4 | S-1 | II-2 | 0.25 | 2.44 | 2.51 | 97% | This Invention |
| 125 | I-4 | S-II | III-9 | 0.27 | 2.42 | 2.50 | 97% | This Invention |
| 126 | I-4 | S-12 | III-12 | 0.29 | 2.45 | 2.52 | 97% | This Invention |
| 127 | I-6 | S-5 | III-13 | 0.26 | 2.43 | 2.49 | 98% | This Invention |
| 128 | I-15 | S-5 | III-13 | 0.30 | 2.41 | 2.50 | 96% | This Invention |
| 129 | I-17 | S-18 | II-12 | 0.26 | 2.38 | 2.45 | 97% | This Invention |
| 130* | I-3 | S-5 | III-13 | 0.20 | 2.51 | 2.51 | 100% | This Invention |
| 131* | I-4 | S-1 | II-2 | 0.25 | 2.50 | 2.50 | 100% | This Invention |
| 132* | I-15 | S-11 | III-9 | 0.28 | 2.49 | 2.51 | 100% | This Invention |

Note:
1) In photographic material Nos. 130, 131, and 132, respectively P-17, P-25, and P-5 was further added as a polymer in the similar weight as the coupler and coated.
2) Compounds repesented by formulae (II) and (III) of the present invention each were used in an amount of 18 mol % per mol of cyan coupler.

As is apparent from the results shown in Table 1, according to the present invention, the leuco compounds of the cyan dyes are not substantially formed, even immediately after the processing, and images high in maximum density are obtained, whereas the case of Comparative Photographic Materials is not desirable in that the forming of leuco compounds cannot be suppressed immediately after the processing, or if the leuco compound is not substantially formed the maximum density is remarkably low in comparison with the present invention. Further, it can be understood that the additional use of the polymer brings about a high maximum density and can suppress further the formation of a leuco compound.

Having described our invention as related to the embodiment, it is our intention that the invention be not limited by any of the details of the description, unless otherwise specified, but rather be construed broadly within its spirit and scope as set out in the accompanying claims.

What we claim is:

1. A silver halide color photographic material having photographic constitutional layers that include at least one silver halide emulsion layer on a base, comprising in at least one of said silver halide emulsion layer silver halide grains having a silver chloride content of 90 mol% or over and an emulsified dispersion containing lipophilic fine particles with an average particle diameter in the range of 0.18 μm to 0.35 μm that include at least one cyan dye-forming coupler represented by formula (I):

Formula (I)

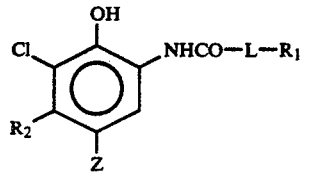

wherein $R_1$ represents an alkyl group having at least 7 carbon atoms, $R_2$ represents an alkyl group having 1 to 15 carbon atoms, L represents a mere bonding line or a bivalent linking group, and Z represents a hydrogen atom or a group or an atom capable of being released at the time of coupling with a developing agent, at least one high-boiling organic solvent having a viscosity of 200 cp or over at 25° C., and at least one compound selected from the group consisting of diffusion-resistant compounds represented by formulae (II) and (III):

Formula (II)

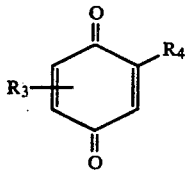

Formula (III)

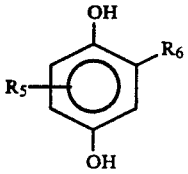

wherein $R_3$, $R_4$, $R_5$, and $R_6$ each represent a hydrogen atom, a halogen atom, or a chain, cyclic, or branched alkyl, alkyloxy, or alkylthio group, provided that $R_3$ and $R_4$ and/or $R_5$ and $R_6$ do not simultaneously represent a hydrogen atom and/or a halogen atom respectively, and of alkyl groups represented by $R_3$ to $R_6$, an alkyl group whose root carbon is a tertiary carbon atom are excluded.

2. The silver halide color photographic material as claimed in claim 1, wherein a blue-sensitive silver halide emulsion layer of the silver halide photographic material contains lipophilic fine particles (A) containing a yellow dye-forming coupler, a green-sensitive silver halide emulsion layer of the silver halide photographic material contains lipophilic fine particles (B) containing a magenta dye-forming coupler, and the average particle diameter of both the lipophilic fine particles (A) and (B) is 0.25 μm or less.

3. The silver halide color photographic material as claimed in claim 1, wherein the silver halide emulsion layer containing at least one coupler of formula (I) further comprises a water-insoluble organic polymer compound.

4. The silver halide color photographic material as claimed in claim 1, wherein $R_1$ in formula (I) represents an alkyl group having 10 to 22 carbon atoms.

5. The silver halide color photographic (I) represents an alkyl group having 2 to 4 carbon atoms.

6. The silver halide color photographic material as claimed in claim 1, wherein $R_4$ or $R_6$ in formula (II) or (III) represents an alkyl group or an alkylthio group each having 6 to 22 carbon atoms.

7. The silver halide color photographic material as claimed in claim 1, wherein $R_3$ or $R_5$ in formula (II) or (III) represents a hydrogen atom or halogen atom.

8. The silver halide color photographic material as claimed in claim 3, wherein the water-insoluble organic polymer is selected from the group consisting of vinyl polymers.

9. The silver halide color photographic material as claimed in claim 3, wherein the water-insoluble organic polymer is selected from the group consisting of polymers obtained by condensation polymerization and addition polymerization.

10. The silver halide color photographic material as claimed in claim 3, wherein the water-insoluble organic polymer is selected from the group consisting of polyesters obtained by ring opening polymerization.

11. The silver halide color photographic material as claimed in claim 3, wherein the weight ratio of the water-insoluble organic polymer to the coupler is in the range of 1:20 to 20:1.

12. The silver halide color photographic material as claimed in claim 1, wherein the cyan coupler represented by formula (I) is used in an amount of 0.1 to 1 mol% per mol of the silver halide in the silver halide photographic layer.

13. The silver halide color photographic material as claimed in claim 1, wherein the compound selected from the group consisting of compounds represented by formula (II) and/or formula (III) are used in an amount of 0.1 to 100 mol% per mol of the cyan coupler.

14. The silver halide color photographic material as claimed in claim 1, wherein the compound represented by formula (II) and the compound represented by formula (III) are used in combination in a molar ratio of 0.01:1 to 10:1.

15. The silver halide color photographic material as claimed in claim 1, wherein the average particle diameter of the emulsified dispersion of lipophilic fine particles is 0.18 to 0.29 μm.

16. The silver halide color photographic material as claimed in claim 1, wherein the high-boiling organic solvent is selected from the group of compounds represented by the following formulae ($II_s$), ($III_s$), ($IV_s$), ($V_s$), ($VI_s$), and ($VII_s$);

Formula ($II_s$)

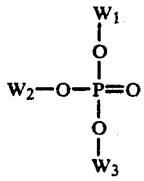

Formula ($III_s$)
$W_1$—COO$W_2$
Formula ($IV_s$)

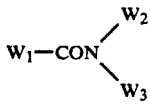

Formula ($V_s$)

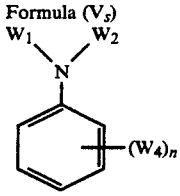

Formula ($VI_s$)
$W_1$—O—$W_2$
Formula ($VII_s$)
$W_5$—X wherein $W_1$, $W_2$, and $W_3$ each represent a substituted or unsubstituted, alkyl group, cycloalkyl group, alkenyl group, aryl group, or heterocyclic group, $W_4$ represents $W_1$, O-$W_1$ or S-$W_1$, n is an integer of 1 to 5, when n is 2 or over, $W_4$ groups may be the same or different, and in formula ($VI_s$), $W_1$ and $W_2$ may together form a condensed ring, $W_5$ represents a substituted or unsubstituted alkyl group, cycloalkyl group, or aryl group, the total number of carbon atoms constituting $W_5$ being 12 or more, and X represents a halogen atom.

17. The silver halide color photographic material as claimed in claim 1, wherein the boiling point of the high-boiling organic solvent is 140° C. or over.

18. The silver halide color photographic material as claimed in claim 1, wherein the weight ratio of the high-boiling organic solvent to be used to the cyan coupler is in the range of 0.05:1 to 20:1.

19. A method for forming an image, which comprises after exposing photographic material as claimed in claim 1 to light image-wise, subjecting the silver halide photographic material to color-development with a color developer substantially free from benzyl alcohol and then treating it with a bleach-fix solution having a pH of 6.3 or below.

* * * * *

UNITED STATES PATENT AND TRADEMARK OFFICE

CERTIFICATE OF CORRECTION

PATENT NO. : 5,082,764

DATED : January 21, 1992

INVENTOR(S) : Takahashi

It is certified that error appears in the above-identified patent and that said Letters Patent is hereby corrected as shown below:

In column 107, line 49, after "photographic" insert --material as claimed in claim 1, wherein $R_1$ in formula--.

Signed and Sealed this

Seventeenth Day of October, 1995

*Attest:*

*Attesting Officer*

BRUCE LEHMAN

*Commissioner of Patents and Trademarks*